US011117409B2

(12) United States Patent
Takahashi et al.

(10) Patent No.: US 11,117,409 B2
(45) Date of Patent: Sep. 14, 2021

(54) STEREOSCOPIC IMAGE FORMING METHOD AND STEREOSCOPIC IMAGE FORMING APPARATUS

(71) Applicant: Konica Minolta, Inc., Tokyo (JP)

(72) Inventors: Seijiro Takahashi, Kokubunji (JP); Kouji Sugama, Musashino (JP); Michiyo Fujita, Hachioji (JP); Haruo Horiguchi, Koganei (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/811,351

(22) Filed: Mar. 6, 2020

(65) Prior Publication Data

US 2020/0338918 A1 Oct. 29, 2020

(30) Foreign Application Priority Data

Apr. 26, 2019 (JP) ..... JP2019-084986

(51) Int. Cl.

| | |
|---|---|
| ***G03G 15/00*** | (2006.01) |
| ***B41M 3/06*** | (2006.01) |
| ***G03G 15/01*** | (2006.01) |
| ***G03G 15/22*** | (2006.01) |

(52) U.S. Cl.

CPC ..... *B41M 3/06* (2013.01); *G03G 15/0194* (2013.01); *G03G 15/224* (2013.01); *G03G 15/6582* (2013.01); *G03G 15/6585* (2013.01); *G03G 2215/00426* (2013.01); *G03G 2215/00476* (2013.01)

(58) Field of Classification Search

CPC ..... G03G 15/6585; G03G 15/0194; G03G 15/2007; G03G 15/224; G03G 15/6573; G03G 15/6582; G03G 2215/00421; G03G 2215/00426; G03G 2215/00476; G03G 15/6591; B41M 3/06

See application file for complete search history.

(56) References Cited

U.S. PATENT DOCUMENTS

| | | | | |
|---|---|---|---|---|
| 2013/0161874 | A1* | 6/2013 | Horiuchi | B29C 44/0461 264/415 |
| 2015/0070452 | A1* | 3/2015 | Motoyanagi | B41J 11/002 347/102 |
| 2018/0272777 | A1* | 9/2018 | Ushigome | B29C 44/56 |
| 2020/0050122 | A1* | 2/2020 | Shibata | G03G 9/08755 |
| 2020/0086668 | A1* | 3/2020 | Fujita | B41J 11/002 |
| 2020/0198385 | A1* | 6/2020 | Morokuma | B29C 44/06 |
| 2020/0207137 | A1* | 7/2020 | Horiuchi | B29C 44/022 |

FOREIGN PATENT DOCUMENTS

| | | | |
|---|---|---|---|
| JP | S64-28659 | A | 1/1989 |
| JP | 2001150812 | A | 6/2001 |
| JP | 2006220740 | A | 8/2006 |

* cited by examiner

*Primary Examiner* — Walter L Lindsay, Jr.
*Assistant Examiner* — Laura Roth
(74) *Attorney, Agent, or Firm* — Lucas & Mercanti, LLP

(57) ABSTRACT

A stereoscopic image forming method forms a color stereoscopic image on a recording medium having a thermal expansion property. The stereoscopic image forming method includes the steps of: fixing a color image on the thermally expandable recording medium using a color material; and irradiating the fixed color image with light of a light source having a maximum emission wavelength in a wavelength range of 280 to 780 nm. This light is absorbed by a compound contained in the color material to generate heat of the compound.

10 Claims, 4 Drawing Sheets

STEREOSCOPIC IMAGE FORMING METHOD AND STEREOSCOPIC IMAGE FORMING APPARATUS

CROSS-REFERENCE TO RELATED APPLICATION

The entire disclosure of Japanese Patent Application No. 2019-084986 filed on Apr. 26, 2019 is incorporated herein by reference in its entirety.

BACKGROUND

Technological Field

The present invention relates to a stereoscopic image forming method and a stereoscopic image forming apparatus. More specifically, the present invention relates to a stereoscopic image forming method and a stereoscopic image forming apparatus capable of obtaining a color stereoscopic image having excellent color reproducibility and sharp edges.

Description of the Related Art

Conventionally, there has been known a thermally expandable recording medium (also referred to as a thermally expandable sheet or a thermally foaming sheet) in which a foam layer (also referred to as a capsule layer) containing expandable microcapsules expanding by heating is formed on one surface side of a base material layer. An image pattern having a high light absorption property is printed on the thermally expandable sheet, and then the thermally expandable layer in the region corresponding to the image pattern is selectively heated and expanded by irradiating light including infrared rays, whereby a stereoscopic (three-dimensional) image corresponding to the image pattern may be formed on one surface side of the base material layer sheet.

As a method of forming a color stereoscopic image by such a stereoscopic image forming technique, for example, Patent Document 1 (JP-A 64-28659) discloses a method of forming a stereoscopic image by forming a printed image on a thermally expandable sheet with a toner of a color material and a material having high light absorption, then irradiating the printed image with light by a halogen lamp to absorb the light to generate heat, and heating the microcapsules of the thermally expandable layer in the region corresponding to the printed image by heating to expand (or foam). Patent Document 2 (JP-A 2006-220740) describes a method of forming a stereoscopic image by irradiating an image composed of a transparent toner containing an infrared absorber and a colored toner image on a thermally expandable recording medium with infrared rays.

Patent Document 3 (JP-A 2001-150812) discloses a method in which a color image is formed on the surface of a thermally expandable sheet on the thermally expandable layer side, a light absorption pattern composed of a gray scale image is formed on the back surface of the base material layer sheet side corresponding to a pattern of the color image on the front surface, and then light is irradiated from the back surface side of the thermally expandable sheet to generate heat corresponding to the density of the light absorption pattern, thereby controlling the amount of expansion of the thermally expandable layer to adjust the height of the elevation of the stereoscopic image.

However, in the method described in Patent Document 1, since black toner is used as a material having high light absorption, there is a problem in color reproducibility. Further, in the method described in Patent Document 2, there is a problem that the color density is lowered because the transparent toner and the colored toner are mixed when the toner is irradiated with light and melted. Further, in the method described in Patent Document 3, since light is irradiated from the back surface of the thermal expansion surface, there is a problem that the edges of the stereoscopic image are blurred and a sharp stereoscopic image cannot be obtained.

Therefore, the conventional method has a problem that a color stereoscopic image having excellent color reproducibility and sharp edges cannot be obtained.

SUMMARY

The present invention has been made in view of the above problems and status. An object of the present invention is to provide a stereoscopic image forming method capable of obtaining a color stereoscopic image having excellent color reproducibility and sharp edges. In addition, a stereoscopic image forming apparatus is provided.

In order to solve the above-mentioned problems, the inventor of the present invention, as a result of examining the causes of the above-mentioned problems, has discovered that a color stereoscopic image having excellent color reproducibility and sharp edges may be obtained by irradiating a color image fixed using a color material with light of a shorter wave wavelength than conventional infrared light, and causing the color material to contain a compound which absorbs light of this wavelength and generates heat. That is, the above-mentioned problem according to the present invention is solved by the following embodiments.

To achieve at least one of the above-mentioned objects according to the present invention, an embodiment reflecting an aspect of the present invention is a stereoscopic image forming method for forming a color stereoscopic image on a recording medium having a thermal expansion property, the stereoscopic image forming method comprising the steps of:

fixing a color image on the thermally expandable recording medium using a color material; and irradiating the fixed color image with light of a light source having a maximum emission wavelength in a wavelength range of 280 to 780 nm that is absorbed by a compound contained in the color material to generate heat of the compound.

Another embodiment reflecting an aspect of the present invention is a stereoscopic image forming apparatus for forming a color stereoscopic image on a thermally expandable recording medium, wherein the stereoscopic image forming apparatus comprises:

a fixing unit for fixing the color image on the thermally expandable recording medium using a color material; and a light irradiating unit for irradiating the fixed color image with light of a light source having a maximum emission wavelength in a wavelength range of 280 to 780 nm that is absorbed by a compound contained in the color material to generate heat of the compound.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
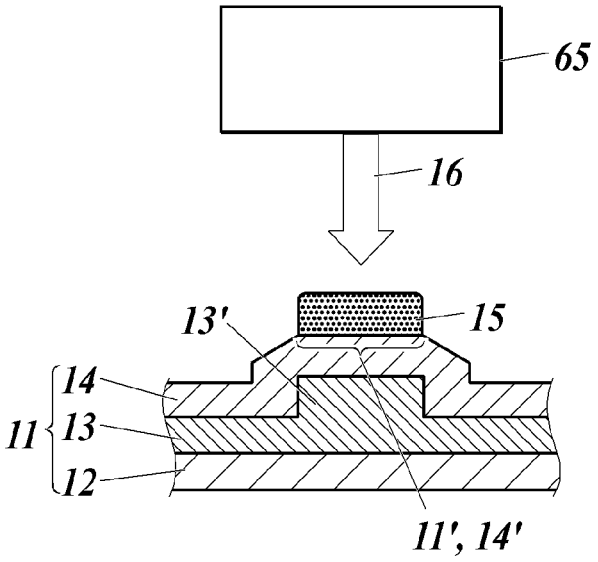
FIG. 1 is a schematic cross-sectional view schematically illustrating a state in which a stereoscopic image according to an embodiment of the present invention is formed.

Hereinafter, one or more embodiments of the present invention will be described. However, the scope of the invention is not limited to the disclosed embodiments.

According to the above-mentioned embodiments of the present invention, it is possible to provide a stereoscopic image forming method capable of obtaining a color stereoscopic image excellent in color reproducibility and having sharp edges. In addition, a stereoscopic image forming apparatus, may be provided.

The expression mechanism or action mechanism of the effect of the present invention is not clarified, but is inferred as follows.

In the present invention, the color material is irradiated with light of a light source having a maximum emission wavelength in a wavelength range of 280 to 780 nm that is absorbed by a compound contained in the color material fixed on the surface of the foam layer. As a color material for forming a stereoscopic image, a color material used in a color image formed by a normal electrophotographic method, an inkjet method, or an analog printing method may be used. Since it is unnecessary to use a transparent toner containing an infrared absorbing agent or a black toner in a superimposed manner in order to enhance the light absorbing property, it is presumed that the color reproducibility is excellent. In addition, it is inferred that a portion to which a color material has been fixed is selectively expanded and raised by irradiating light of a shorter wavelength from the surface side of the foam layer than in the related art, so that the edge becomes a sharp image.

The stereoscopic image forming method of the present invention is a stereoscopic image forming method for forming a color stereoscopic image on a recording medium, wherein the recording medium has thermal expansion property, and the method comprises the steps of: fixing a color image on the thermally expandable recording medium using a color material, and irradiating the fixed color image with light of a light source having a maximum emission wavelength in a wavelength region in the range of 280 to 780 nm in that is absorbed by a compound contained in the color material to generate heat of the compound. This feature is a technical feature common to or corresponding to each of the embodiments described below.

As an embodiment of the present invention, in the light irradiation step, it is preferable to irradiate light of a light source having a maximum emission wavelength in a wavelength region in the range of 280 to 480 nm. This is because a toner to which a colorant is generally added absorbs light in a short wavelength region of 280 nm or more and 480 nm or less, so that it is not necessary to change a light source depending on the type of the colorant, and space may be saved by simple formation of an apparatus.

Further, in the present invention, it is preferable that the color material is a color toner for electrophotography. As a result, sufficient energy for stereoscopic image formation may be obtained, and a stereoscopic image having high fixing strength, large bumps, and sharp edges may be obtained.

In view of the effect of the present invention, as an embodiment of the present invention, in the light irradiation step, it is preferable to irradiate light by a light emitting diode or a laser light source, since the light emitting diode or the laser light source has a narrow irradiation wavelength range of light and can irradiate only light in a wavelength range in which a toner image is absorbed, so that efficiency and power consumption may be reduced.

Further, in the present invention, in the light irradiation step, it is preferable to set the light irradiation position based on the position information of the color image. This makes it possible to irradiate only a necessary portion of the recording medium without irradiating the entire surface thereof, thereby making it possible to save energy.

According to an embodiment of the present invention, in the light irradiation step, the light irradiation amount may be set based on the stereoscopic image information of the color image from the viewpoint of the effect expression of the present invention. As a result, the height of the elevation may be controlled for each position, and a variety of stereoscopic image representations may be performed.

It is preferable that the color material contains a colorant as the compound. Further, in the present invention embodiment, in the light irradiation step, it is preferable to irradiate light with an irradiation dose ranging from 1.0 to 20.0 J/cm$^2$. This allows the elevation height to be controlled.

In an embodiment of the present invention, from the viewpoint of the effect expression of the present invention, it is preferable that the color material contains an ultraviolet absorber as the compound.

In addition, it is preferable that the thermally expandable recording medium has a foam layer containing microcapsules that expand by heating on the base material layer because of thermal expansion.

It is preferable that the stereoscopic image forming apparatus of the present invention is a stereoscopic image forming apparatus for forming a color stereoscopic image on a thermally expandable recording medium, and has a fixing unit for fixing a color image on the thermally expandable recording medium using a color material, and a light irradiating portion for irradiating the fixed color image with light of a light source having a maximum emission wavelength in a wavelength region in the range of 280 to 780 nm that is absorbed by a compound contained in the color material, thereby causing the compound to emit heat.

Hereinafter, detailed descriptions will be given of the present invention, its constituent elements, and modes and modes for carrying out the present invention. In the present description, when two figures are used to indicate a range of value before and after "to", these figures are included in the range as a lowest limit value and an upper limit value.

<<General Outline of Stereoscopic Image Forming Method of the Present Invention>>

The stereoscopic image forming method of the present invention is a stereoscopic image forming method for forming a color stereoscopic image on a recording medium, wherein the recording medium has thermal expansion property, and the method contains the steps of: fixing a color image on the thermally expandable recording medium using a color material; and irradiating the fixed color image with light of a light source having a maximum emission wavelength in a wavelength region in the range of 280 to 780 nm that is absorbed by a compound contained in the color material to generate heat of the compound.

The thermally expandable recording medium (thermally expandable sheet) used in the present invention has a foam layer (capsule layer) containing a large number of microcapsules expanding by heating on a base layer.

In the present invention, the color material is irradiated with light in a wavelength range of 280 to 780 nm which is absorbed by the compound contained in the color material fixed on the thermally expandable sheet. The compound contained in the color material irradiated with light makes transition from the ground state to the excited state, and thereafter, is deactivated without radiation, and returns to the ground state again. In this case, thermal energy is released. The released thermal energy transfers heat to the thermally expandable sheet at the portion where the color material has been fixed, and the foam layer in the thermally expandable sheet may be expanded and raised to form a stereoscopic image.

Therefore, in the present invention, a color material for forming a stereoscopic image can use a color image formed by an ordinary electrophotographic method, an inkjet method, or an analog printing method, and it is unnecessary to use a transparent toner containing an infrared absorbing agent or a black toner in a superimposed manner in order to enhance light absorption, so that color reproducibility is excellent. In addition, it is presumed that a portion to which a color material has been fixed is selectively expanded and raised by irradiating light of a shorter wavelength from the surface side of the foam layer than in the related art, so that the edge becomes a sharp image.

[Configuration of Stereoscopic Image]

FIG. 1 is a schematic cross-sectional view schematically illustrating a state in which a stereoscopic image according to an embodiment of the present invention is formed. As illustrated in FIG. 1, the thermally expandable sheet 11 has a foam layer 13 having a number of microcapsules (not illustrated) which expand upon heating on a base layer 12. Further, a coating layer 14 may be provided on the foam layer 13.

After the color image 15 is transferred onto the surface of the foam layer 13, the color image 15 is irradiated with light 16 of a light source having a maximum emission wavelength in a wavelength range in the range of 280 to 780 nm, which is light in a wavelength range that is capable of being absorbed by a compound contained in the color image 15, with respect to the medium surface on which the color image 15 is formed. The compound irradiated with the light 16 transfers heat to the sheet portion 11' to which the color image is attached, and expands the microcapsules in the foam layer 13' of the sheet portion 11'. When the thermally expandable sheet 11 further comprises a coating layer 14, the expanded foam layer 13' and the upper coating layer 14' are expanded and raised to form a stereoscopic image.

Hereinafter, a stereoscopic image forming apparatus and a stereoscopic image forming method according to an embodiment of the present invention will be described in detail by taking a stereoscopic image using a toner image formed by an electrophotographic method as a color image according to the present invention by taking as an example.

<Stereoscopic Image Forming Apparatus>

Figure 2:
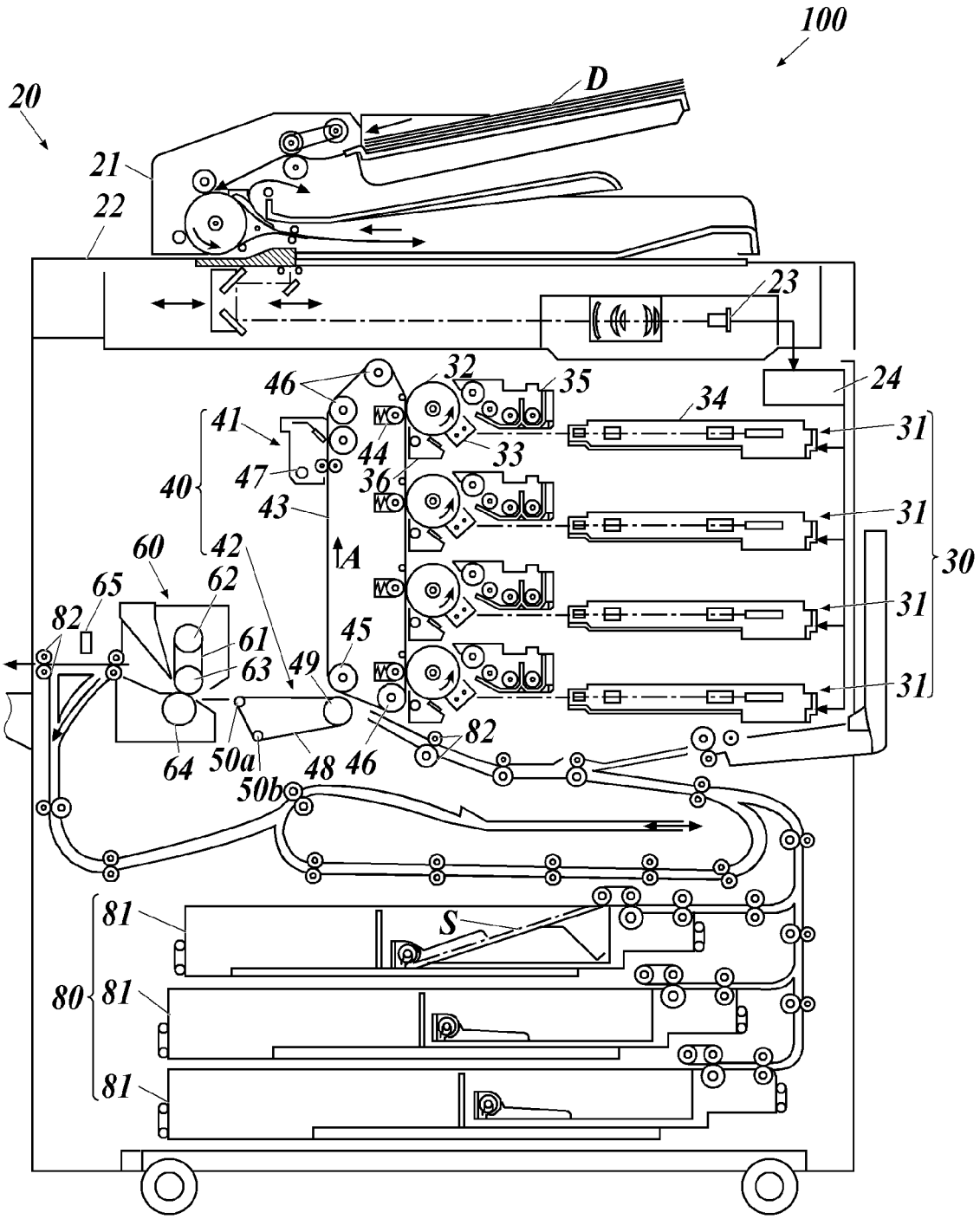
FIG. 2 is a schematic configuration diagram indicating an image forming apparatus according to an embodiment of the present invention.

FIG. 2 is a schematic sectional view illustrating a basic configuration of the stereoscopic image forming apparatus 100 according to an embodiment of the present invention. The stereoscopic image forming apparatus 100 of the present invention is a stereoscopic image forming apparatus for forming a color stereoscopic image on a thermally expandable recording medium S, and is provided with a fixing unit 60 for fixing a color image on the thermally expandable recording medium S using a color material and a light irradiating unit 65 for irradiating the fixed color image with light of a light source having a maximum emission wavelength in a wavelength range of 280 to 780 nm that is absorbed by a compound contained in the color material, thereby causing the compound to emit heat.

Figure 3:
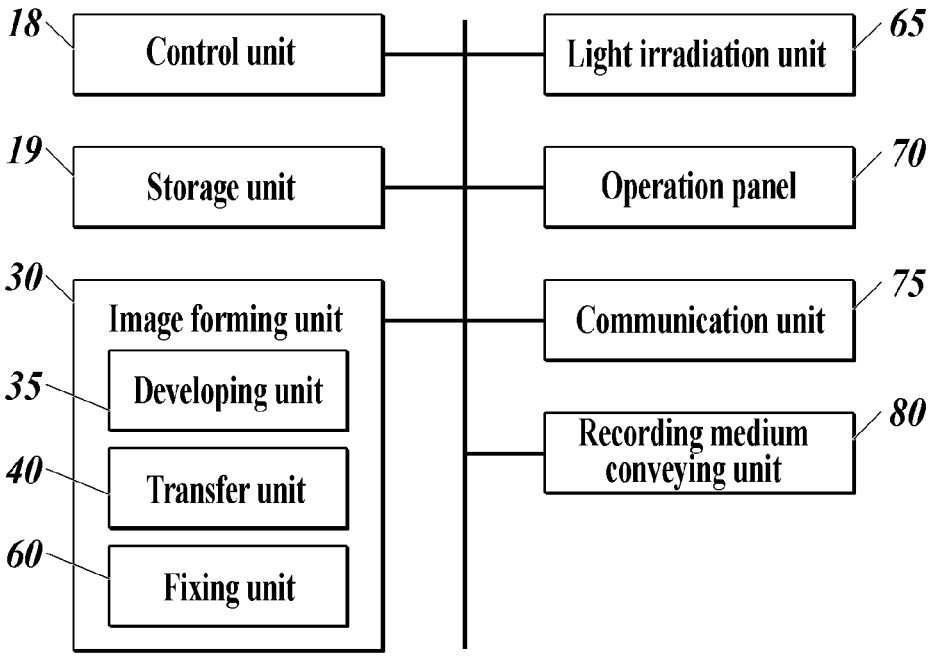
FIG. 3 is a block diagram indicating a hardware configuration of the image forming apparatus.

As illustrated in FIG. 3, the stereoscopic image forming apparatus 100 preferably further includes: a control unit 18, a storage unit 19, an image forming unit 30 (including a developing unit 35 that develops an electrostatic latent image with a toner to form a two-dimensional toner image, a transfer unit 40 and a fixing unit 60), an operation panel 70, a communication unit 75, and a recording medium conveying unit 80. The image forming unit 30 includes a developing unit 35 for developing a toner image, and an intermediate transfer unit 40 for transferring the developed toner image to the recording medium S.

The control unit 18 (not illustrated) includes a CPU (Central Processing Unit), a RAM (Random Access Memory), and a ROM (Read Only Memory). The data processed by the control unit 18 is temporarily stored in the RAM. Various programs and various data are stored in the ROM.

The storage unit 19 (not illustrated) stores various setting information related to the image forming apparatus 100. For example, a correspondence relationship between the position of each pixel of the image in the print image data, which will be described later, and the irradiation exposure position of the light irradiation unit 65 is stored. In addition, a correspondence relationship between a three-dimensional height (raised height) of the recording medium, which will be described later, and an irradiation energy is stored.

The operation panel 70 (not illustrated) includes a touch panel, a ten-key pad, a start button, and a stop button, and functions as a display unit and an operation unit. The operation panel 70 is used to input various settings such as printing conditions, display the state of the apparatus, and input various instructions. In addition, through the operation panel 70, the user can set which region (hereinafter, referred to as a "stereoscopic region") the toner image in the image region of the image data is to be a stereoscopic image, and the height (raised height) of the stereoscopic image when the image is to be a stereoscopic image. The stereoscopic region may be specified in object units (characters such as characters, lines, or photographic images) of the image, or by specifying region coordinates. Further, the height (raised height) of the stereoscopic region may be uniformly set to the same height on one sheet of the recording medium S having a thermal expansion property, or may be set to a plurality of heights for each partial region in one sheet of the recording medium having a thermal expansion property (hereinafter, also simply referred to as a recording medium). Hereinafter, the information of the stereoscopic regions and the information of the heights are collectively referred to as "stereoscopic image information".

The communication unit 75 (not illustrated) is an interface for various local connections, such as a wired communication network interface according to a standard such as Ethernet (registered trademark), or a radio communication interface according to a standard such as Bluetooth (registered trademark) or IEEE802. 11, and performs communication with a user terminal such as a PC (personal computer) connected to a network. The user may set stereoscopic image information for the print image data using a printer driver on the PC. In this case, the image forming apparatus 100 receives a print job composed of the stereoscopic image information and the print image data via the communication unit 75.

(Input Mechanism for Stereoscopic Image Data (Stereoscopic Image Information))

In the stereoscopic image forming apparatus 100 of the present embodiment, it is preferable that the image reading unit 20 is provided. The image reading unit 20 reads an image from the document D and obtains image data for forming an electrostatic latent image. The image reading unit 20 includes a sheet feeding device 21, a scanner 22, a CCD sensor 23, and an image processing unit 24. Also in the present embodiment, when an image can be read from the document D of the stereoscopic image, the image reading unit 20 may be used as it is.

For example, a document D of a stereoscopic image placed on a document table of a sheet feeder (automatic document feeder) 21 is scanned and exposed by an optical system of a scanning exposure device of a scanner (image reading device) 22, and is read by a CCD sensor (image sensor CCD) 23. The analog signals photoelectrically converted by the image sensor CCD23 are subjected to analog processing, A/D conversion, shading correction, and image compression processing in the image processing unit 24, and then inputted to the exposure device 34 of the image forming unit 30.

When it is difficult to read an image because the document D is a stereoscopic image, the stereoscopic image information may be set by the operation panel 70 or an external PC (printer driver) as described above.

(Configuration of Image Forming Unit Having Developing Unit)

In the stereoscopic image forming apparatus 100 of the present embodiment, the image forming unit 30 may include, for example, four image forming units 31 corresponding to yellow, magenta, cyan, and, when necessary, black. The image forming unit 31 may include a photoreceptor drum 32, a charging device 33, an exposure device 34, a developing unit 35, and a cleaning device 36.

The photoreceptor drum 32 is, for example, a negatively charged organic photosensitive member having photoconductivity. The charging device 33 charges the photoreceptor drum 32. The charging device 33 is, for example, a corona charger. The charging device 33 may be a contact charging device for charging the photoreceptor drum 32 by contacting a contact charging member such as a charging roller, a charging brush, or a charging blade. The exposure device 34 irradiates the charged photoreceptor drum 32 with light based on the print image data to form an electrostatic latent image. The exposure device 34 is, for example, a semiconductor laser. The developing unit 35 develops the electrostatic latent image with toner to form a toner image. More specifically, the developing unit 35 supplies toner to the photoreceptor drum 32 on which the electrostatic latent image is formed to form a toner image corresponding to the electrostatic latent image. The developing unit 35 is, for example, a known developing unit in an electrophotographic image forming apparatus. The cleaning device 36 removes residual toner from the photoreceptor drum 32. Here, the "toner image" refers to a state in which toner is gathered on the photoreceptor drum 32 in an image form. The "toner image" refers to a state in which toner is gathered in an image form on the recording medium S.

The toner is not particularly limited as long as it contains a compound (also simply referred to as compound A) which absorbs light from a light source having a maximum emission wavelength in a wavelength range of 280 to 780 nm, and may be appropriately selected from known toners which satisfy the above requirements. The toner may be used as a one-component developer or may be mixed with carrier particles and used as a two-component developer. The one-component developer is composed of toner particles. The two-component developer is composed of toner particles and carrier particles. The toner particles are composed of toner base particles and an external additive such as silica attached to the surface thereof. The toner base particle is composed of, for example, a binder resin, a colorant, and a wax. The specific configuration and condition requirements of the toner will be described later.

(Configuration of the Transfer Unit)

The stereoscopic image forming apparatus 100 according to the present embodiment includes a transfer unit 40 that transfers a toner image onto the recording medium S. Hereinafter, a configuration in which the intermediate transfer portion illustrated in FIG. 2 is used as the transfer unit 40 will be described as an example, but the present invention is not limited thereto. As illustrated in FIG. 2, the intermediate transfer unit 40 includes a primary transfer unit 41 and a secondary transfer unit 42. The primary transfer unit 41 includes an intermediate transfer belt 43, a primary transfer roller 44, a backup roller 45, a plurality of first support rollers 46, and a cleaning device 47. The intermediate transfer belt 43 is an endless belt. The intermediate transfer belt 43 is stretched by a backup roller 45 and a first support roller 46. The intermediate transfer belt 43 is driven by at least one roller of the backup roller 45 and the first support roller 46 at a constant speed in one direction on the endless track.

The secondary transfer unit 42 includes a secondary transfer belt 48, a secondary transfer roller 49, and a plurality of second support rollers 50, for example, two second support rollers 50*a* and 50*b*. The secondary transfer belt 48 is an endless belt. The secondary transfer belt 48 is stretched by a secondary transfer roller 49 and second supporting rollers 50*a* and 50*b*.

(Configuration of Light Irradiating Unit)

The stereoscopic image forming apparatus 100 according to the present embodiment includes a light irradiating unit for irradiating the medium surface on which the toner image is formed with light of a light source having a maximum emission wavelength in a wavelength region in the range of 280 to 780 nm that is absorbed by a compound contained in the toner. For example, the light irradiation unit 65 is provided at a position on the recording medium S on the downstream side of the fixing unit 60 where the medium surface on which the toner image is formed is irradiated.

The light irradiating unit 65 is a device for irradiating the toner image with light of a light source having a maximum emission wavelength in a wavelength region in the range of 280 to 780 nm. The light source that may be used for the light irradiation unit 65 is not particularly limited as long as it can irradiate the above-mentioned specific light, but a light emitting diode (LED) or a laser light source is preferable. The light emitting diode and the laser light source are excellent in that the irradiation wavelength range of light is narrow and only light in the wavelength range which is absorbed by the toner image may be irradiated, so that efficiency is high and power consumption may be reduced. Note that, when the irradiation wavelength range is wide, the efficiency is low and the power consumption becomes large including light having a wavelength at which the toner cannot absorb light, but any light source capable of irradiating the specific light described above may be applied.

The wavelength region of the light irradiated by the light irradiation unit 65 is light in a wavelength region that is absorbed by a compound A contained in the toner, and the maximum emission wavelength of the light is in the range of 280 to 780 nm. The "maximum emission wavelength" of the light source which may be used for the light irradiation unit 65 refers to an emission wavelength at which the emission intensity is maximum among the local maxima of the emission peak (emission band) in the emission spectrum of the light source. In order to fix the toner image and perform stereoscopic image formation, it is necessary to efficiently raise the temperature of the toner, heat-melt the toner, transfer heat to the recording medium S, and expand the microcapsules of the foam layer. The amount of thermal energy emitted depends on the energy corresponding to the wavelength of light to be irradiated, the absorbance of the compound A, and the light-stability of the compound A. Toward a compound A (for example, a colorant or an ultraviolet absorber) that absorbs light in a wavelength range of 280 to 780 nm contained in the toner, by irradiating the light of the light source having the maximum emission wavelength in the wavelength region where the compound A absorbs light, a stereoscopic image with high fixing strength, large ridges and sharp edges may be obtained.

It is preferable that the maximum emission wavelength of the light irradiated by the light irradiating unit 65 is in the range of 280 to 680 nm. The reason for this is that sufficient energy is obtained for fixing and stereoscopic image formation of the toner image, and a stereoscopic image having high fixing strength, large bumps, and sharp edges is obtained. Further, the maximum emission wavelength of light is more preferably in the range of 280 to 480 nm. This is because commonly used toner to which a colorant (dye) is added absorbs light in a short wavelength region in the range of 280 to 480 nm, so that there is no need to change the light source depending on the type of colorant, and space may be saved by simple device formation.

The light source used in the light irradiating unit 65 may be arranged so as to irradiate the entire area of the medium in the lateral direction (also referred to as the width direction or main scanning direction) perpendicular to the conveying direction (longitudinal direction of the medium) of the recording medium S at a time, or may be partially irradiated, or may be arranged so as to change the irradiation position by arranging a plurality of light sources in the width direction. For example, a plurality of LEDs that emit ultraviolet light and a plurality of lenses that are arranged along the width direction may be used so that the entire area in the width direction may be irradiated. The LED may be irradiated on the recording medium S with a resolution of 1 dpi or more, for example. Preferably, irradiation with a resolution of 50 dpi is preferred, and more preferably 100 dpi or more.

In addition, it is preferable that the irradiation energy for each dot may be controlled in a plurality of stages. For example, it is preferable that the control may be performed in a plurality of steps ranging from several to several tens of $J/cm^2$. The increase or decrease of the irradiation energy may be controlled by controlling the light emission amount of the LED, or by changing the conveying speed of the recording medium S to be conveyed directly under the light irradiation unit 65. As a result, the recording medium S may be continuously irradiated while being conveyed. In this case, a method of irradiating light while conveying the recording medium S may be used as the light irradiation. The light source may be arranged so as to irradiate the entire surface of the recording medium S at a time. Thus, after the recording medium S is stopped immediately below the light source, the entire area of the recording medium S may be irradiated at once. In this case, the light irradiation may be performed by stopping the recording medium S at the irradiation position for each sheet and performing the light irradiation.

As the light source, a semiconductor laser may be used. A plurality of semiconductor lasers may be arranged so that the entire area of the recording medium may be irradiated at a time, the semiconductor laser may be moved so that the entire area of the recording medium may be sequentially irradiated with light, or a method of scanning by rotating a polygon mirror with laser light irradiated from the semiconductor laser may be used.

In the present embodiment, the compound A that absorbs light in the wavelength range to be irradiated means a compound that is dissolved in a solvent at a concentration of 0.01 mass % and has an absorbance of 0.01 or more at the maximum emission wavelength in the wavelength range of 280 to 780 nm to be irradiated when the absorbance is measured by a spectrophotometer. As the solvent, for example, DMF, THF, or chloroform may be used.

The amount of light irradiated by the light irradiation unit 65 may be controlled in accordance with the type and content of the compound A contained in the toner within a range in which the effect of the invention may be obtained. For example, the amount of radiation light is preferably controlled within a range of not less than 0.1 $J/cm^2$ and not more than 50.0 $J/cm^2$, and more preferably within a range of not less than 1.0 $J/cm^2$ and not more than 20.0 $J/cm^2$.

The recording medium conveyance unit 80 includes three sheet feed tray units 81 and a plurality of registration roller pairs 82. The paper feed tray unit 81 accommodates recording media S identified on the basis of the basis weight, size, and foaming magnification for each preset type. The registration roller pair 82 is disposed so as to form an intended conveyance path.

In the stereoscopic image forming apparatus 100 of the present embodiment, the fixing unit 60 is provided so that normal two-dimensional image formation using a normal recording medium may also be performed. The fixing unit 60 includes an endless fixing belt 61, a heating roller 62 having a heating device (not illustrated) for heating the fixing belt 61 from the inside, and includes two or more rollers 62 and 63 for pivotally supporting the fixing belt 61, and a pressure roller 64 arranged so as to be relatively urged with respect to one of the rollers (roller 63) via the fixing belt 61. The fixing unit 60 is, for example, a known fixing unit in an electrophotographic image forming apparatus (fixing device).

In the stereoscopic image forming method using the image forming apparatus 100, a toner image is formed on the recording medium S sent from the recording medium conveying unit 80 by the transfer unit 40 based on the image data acquired by the image reading unit 20 or the stereoscopic image information specified by the user. The recording medium S on which the toner image is formed by the transfer unit 40 is sent to the fixing unit 60.

Thereafter, based on the position information of the toner image and the stereoscopic image information (external information) specified by the user, the light irradiation unit 65 irradiates the set light irradiation position with light within a specific wavelength range of the set irradiation amount. As a result, the compound A absorbs light within a specific wavelength range irradiated on the toner image, and after transitioning from the ground state to the excited state, the compound A is deactivated without radiation and returns to the ground state again. At this time, thermal energy is released, and the peripheral resin constituting the toner image is softened and melted by the released thermal energy, and the thermal energy generated from the toner image is transferred to the sheet portion to which the toner image is attached. As a result, the microcapsules in the foam layer of the sheet portion expand, and the coating layer portion immediately above the expanded foam layer may be expanded and raised to form a stereoscopic image. The toner image thus fixed on the recording medium S is irradiated with specific light to quickly form a stereoscopic image on the recording medium S. The recording medium S on which the stereoscopic image is formed by the light irradiation unit 65 is guided to the outside of the image forming apparatus 100 by a guide roller (not illustrated).

When a normal (two-dimensional) image formation is performed using a normal recording medium, the recording medium S carrying an unfixed toner image is sent to the fixing unit 60 without being irradiated with light by the light irradiation unit 65, and guided to the nip portion while being guided by a guide plate (not shown). Then, the fixing belt 61 is brought into close contact with the recording medium S, so that the unfixed toner image is quickly fixed to the recording medium S. The recording medium S receives an airflow from an airflow separation device (not illustrated) at the downstream end of the fixing nip portion. Therefore, separation of the recording medium S from the fixing belt 61 is promoted. The recording medium S separated from the fixing belt 61 is guided to the outside of the image forming apparatus 100 by a guide roller (not illustrated).

That is, the stereoscopic image forming apparatus of the present embodiment is a stereoscopic image forming apparatus having a light irradiating unit for quickly forming a stereoscopic image on the recording medium S by irradiating a toner image formed by fixing on the recording medium S having a thermal expansion property by an electrophotographic method with light in a wavelength region that is absorbed by a compound contained in the toner. With such a configuration, the effects of the above-described invention may be effectively exhibited.

<Stereoscopic Image Forming Method>

Figure 4:
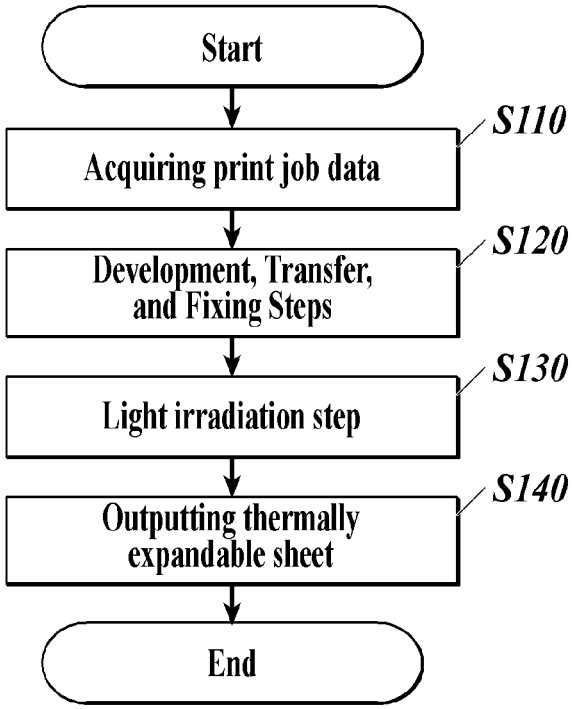
FIG. 4 is a flowchart indicating a procedure of a stereoscopic image forming method.

Hereinafter, the stereoscopic image forming method of the present embodiment will be described with reference to FIG. 4. FIG. 4 is a flowchart indicating a procedure of a stereoscopic image forming method.

(Step S110)

The image forming apparatus 100 acquires print job data. The print job data includes print image data and stereoscopic image information. The print image data is image data obtained by reading an image from a document D by the image reading unit 20, or image data received via the communication unit 80. The stereoscopic image information is information input by the user via the operation panel 70.

(Step S120: Development, Transfer, and Fixing Steps)

The present embodiment includes a developing step of forming a toner image by developing the electrostatic latent image with a toner in step S120, and a transfer step and a fixing step of transferring the toner image to a recording medium.

More specifically, the image forming unit 30 forms a toner image on a recording medium by a developing process and a transferring process based on the print image data acquired in step S110. When the image recording is started, the Y photoreceptor drum 32 (the uppermost photoreceptor drum in the drawing) is rotated in the direction indicated by the arrow in the drawing by starting the photoreceptor drum drive motor (not illustrated), and a potential is applied to the Y photoreceptor drum 32 by the Y charging device 33. After the potential is applied to the Y photoreceptor drum 32, exposure (image writing) by an electric signal corresponding to the first color signal, that is, the Y image data is performed by the Y exposure device 34, and an electrostatic latent image corresponding to the yellow (Y) image is formed on the Y photoreceptor drum 32. This latent image is reversely developed by the developing unit 35 of Y, and a toner image made of yellow (Y) toner is formed on the photoreceptor drum 32 of Y (developing process). The Y toner image formed on the Y photoreceptor drum 32 is transferred onto an intermediate transfer belt 43 which is an intermediate transfer member by a primary transfer roller 44 as a primary transfer means.

Next, a potential is applied to the M photoreceptor drum 32 (the second photoreceptor drum from the top in the figure) by the M charger 33. After the M photoreceptor drum 32 are applied with a potential, exposure (image writing) is performed by the M exposure device 34 using a first color signal, that is, an electric signal corresponding to M image data, and an electrostatic latent image corresponding to a magenta (M) image is formed on the M photoreceptor drum 32. This latent image is reversely developed by the M developing unit 35, and a toner image made of magenta (M) toner is formed on the M photoreceptor drum 32 (developing step). The M toner image formed on the M photoreceptor drum 32 is transferred onto the intermediate transfer belt 43, which is an intermediate transfer member, by the primary transfer roller 44 serving as a primary transfer means so as to be superimposed on the Y toner image.

By the same process, a toner image composed of cyan (C) toner formed on the C photoreceptor drum 32 (the third photoreceptor drum from the top in the figure) and a toner image composed of black (K) toner formed on the K photoreceptor drum 32 (the lowest photoreceptor drum in the figure) as necessary are successively superimposed on the intermediate transfer belt 43, and a superimposed color toner image composed of Y, M, C and K toner is formed on the peripheral surface of the intermediate transfer belt 43. The toner remaining on the peripheral surface of each of the photoreceptor drums 32 after the transfer is cleaned by the photosensitive cleaning device 36.

On the other hand, the recording medium S having a thermal expansion property as recording paper accommodated in the three paper feed tray unit 81 of the recording medium conveyance unit 80 is fed by feed rollers and paper feed rollers respectively provided in the three paper feed tray units 81, conveyed on a conveyance path by conveyance rollers, conveyed to the secondary transfer belt 48 as a secondary transfer means to which a voltage having a polarity opposite to that of the toner (positive polarity in this embodiment) is applied via a pair of registration rollers 82, and in the transfer region of the secondary transfer belt 48, the superimposed color toner images formed on the intermediate transfer belt 43 are collectively transferred onto the recording medium S (transfer process). At this time, as illustrated in FIG. 1, the recording medium S having a thermal expansion property may be accommodated in the paper feed tray unit 81 so that the color toner image is transferred collectively onto the coating layer 14 of the thermally expandable sheet 11 which is the recording medium S.

After the toner image is transferred onto the recording medium S by the secondary transfer belt 48 as the secondary transfer means, the residual toner on the intermediate transfer belt 43 which has been subjected to curvature separation of the recording medium S is removed by the intermediate transfer belt cleaning device 47. Further, the patch image toner on the secondary transfer belt 48 is cleaned by the cleaning blade of the secondary transfer unit 42.

Subsequently, in the fixing unit 60, a color image is fixed on the thermally expandable recording medium by using a color material. In the fixing unit, the color toner image transferred collectively onto the recording medium S is passed and fixed without coming into contact with the fixing belt 61 which has moved upward following the heating roller 62. In this fixing step, in the fixing unit 60, it is preferable that the fixing temperature is in a range in which the toner image is fixed but the microcapsules in the foam layer are not foamed.

(Step S130: Light Irradiation Step)

In the light irradiation step, the fixed color image is irradiated with light of a light source having a maximum emission wavelength in a wavelength range of 280 to 780 nm that is absorbed by a compound contained in a color material, and the compound is heated. More specifically, the surface of the medium on which the toner image is formed is irradiated with light of a wavelength region capable of absorption the compound contained in the toner and having a maximum emission wavelength in a wavelength region in the range of 280 to 780 nm.

In the light irradiation step of step S130, the control unit 18 controls the light irradiation unit 65, and the recording medium S to which the toner image is transferred in the transfer step is irradiated with the light of the specified wavelength region in the light irradiation unit 65 to form a stereoscopic image on the recording medium S. Thereafter, the recording medium S on which the stereoscopic image is formed is conveyed through the apparatus and placed on a sheet discharge tray outside the image forming apparatus 100.

More specifically, in the recording medium S on which the toner image has been fixed in the fixing step, light in a specific wavelength range of the set irradiation amount is irradiated from the light irradiating unit 65 to the set irradiation position of light based on the position information of the toner image and the stereoscopic image information designated by the user. As a result, the compound A absorbs light in a specific wavelength range irradiated on the toner image, and after transitioning from the ground state to the excited state, the compound A is deactivated without radiation and returns to the ground state again. At this time, thermal energy is released, and by this released thermal energy, thermal energy generated from the toner image is transferred to the sheet portion to which the toner image is adhered, and the microcapsules in the foam layer of the sheet portion are expanded, and the foam layer (further, the coating layer directly above the foam layer) is raised to form a stereoscopic image.

(Step S140: Outputting Thermally Expandable Sheet)

In step S130, the recording medium S on which the stereoscopic image of the toner image is formed by the light irradiating unit 65 is guided to the outside of the image forming apparatus 100 in step S140, and is placed on a sheet discharge tray outside the stereoscopic image forming apparatus 100.

It may also be said that the stereoscopic image forming apparatus 100 of the present embodiment is an apparatus used in the stereoscopic image forming method of the present embodiment including the steps described above.

(Light Wavelength Region to be Irradiated)

In the light irradiation step, it is preferable to irradiate light of a light source having a maximum emission wavelength in a wavelength range of 280 to 680 nm. This is because sufficient energy is obtained for fixing the toner image and stereoscopic image formation, and a stereoscopic image having high fixing strength, large bumps, and sharp edges is obtained. Further, in the light irradiation step, it is more preferable to irradiate the light of the light source having the maximum emission wavelength in the wavelength region within the range of 280 to 480 nm. This is because a toner to which a commonly used colorant is added absorbs light in a short wavelength range of 280 to 480 nm, so that there is no need to change a light source depending on the type of colorant, and space may be saved by simple device formation.

(Setting of Light Irradiation Position and Light Irradiation Amount)

In the light irradiation step, the light irradiation position of the specific wavelength region may be set based on the positional information of the toner image based on the print image data. This makes it possible to irradiate only a necessary portion of the recording medium without irradiating the entire surface thereof, thereby making it possible to save energy. In the light irradiation step, the irradiation amount of light in the specific wavelength region may be set based on the stereoscopic image information of the toner image specified by the user. Further, in the light irradiation step, the light irradiation position and the light irradiation amount may be set based on the positional information of the toner image based on the print image data and the stereoscopic image information of the toner image specified by the user. As described above, it is possible to save energy, control the height of the elevation for each position, and to express a variety of stereoscopic images.

The positional information of the toner image is printing image information indicating which position of the toner image is desired to be stereoscopic, and is designated by the user from, for example, an input screen. The stereoscopic image information may be data obtained by converting the printing image data into three-dimension. The stereoscopic image information is printing image information indicating which position of the toner image is desired to be stereoscopic, and is designated by the user from, for example, an input screen. Which position of the toner image is desired to be a three-dimensional image may be controlled to an arbitrary height in accordance with the irradiation energy of light. For example, when the height is controlled to five levels, the height may be controlled arbitrarily by setting the first level to 5.0 J/cm$^2$, the second level to 7.5 J/cm$^2$, the third level to 10.0 J/cm$^2$, the fourth level to 15.0 J/cm$^2$, and the fifth level to 20.0 J/cm$^2$ in order from the lower level.

The light irradiation may be performed by a method of performing light irradiation while conveying the recording medium S, or by a method of performing light irradiation by stopping the recording medium S one by one at the irradiation position. Preferably, the recording medium S is irradiated with light while being conveyed, because productivity may be increased.

The irradiation size depends on the type and size of the light source and the optical system (such as a lens), but a higher resolution is preferable. The position information of the stereoscopic image may be 1 dpi or more, preferably 50 dpi or more, and more preferably 100 dpi or more.

(Configuration of Recording Medium with Thermal Expansion)

Figure 5A:
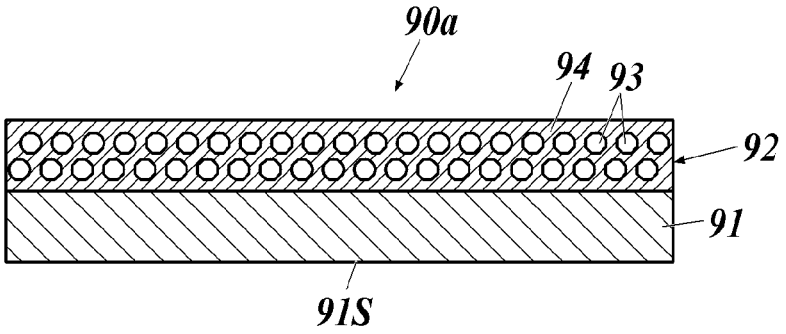
FIG. 5A is a schematic cross-sectional view schematically illustrating one embodiment of a recording medium having a thermal expansion property.
Figure 5B:
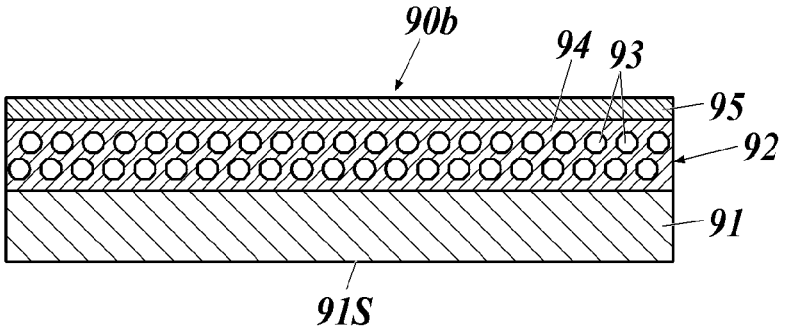
FIG. 5B is a schematic cross-sectional view schematically illustrating one embodiment of a recording medium having a thermal expansion property.

The expandable recording medium according to the present invention preferably has a foam layer containing microcapsules expanding by heating on a base material layer. FIG. 5A is a schematic cross-sectional view schematically showing one embodiment of a recording medium having a thermal expansion property. FIG. 5B is a schematic cross-sectional view schematically showing another embodiment of the recording medium having thermal expansion property.

As illustrated in FIG. 5A, a recording medium 90*a* having a thermal expansion property representing one embodiment of the present embodiment may have a configuration including a base material layer 91 and a foam layer 92 laminated on the base material layer 91.

The base material layer 91 is provided for the purpose of supporting the foam layer, and specifically, a sheet of paper such as fine paper or medium paper or a sheet of resin which is generally used may be used. The thickness of the base material layer 91 is preferable in the range of 10 μm or more and 1000 μm or less, and more preferably in the range of 30 μm or more and 50 μm or less in view of the above-mentioned purpose of use.

The foam layer 92 is provided for the purpose of forming a stereoscopic image by the foamed bump, and includes a large number of microcapsules 93 that are spatially distributed, and a covering portion 94 that covers these microcapsules 93. The thickness of the foam layer 92 before the foam bump is preferably in the range of 30 μm or more and 1000 μm or less, more preferably in the range of 50 μm or more and 500 μm or less, from the viewpoint of controlling the height after the foam bump.

The microcapsule 93 is obtained by encapsulating propane, butane, or other low boiling point vaporizable substances with a thermoplastic resin such as vinylidene chloride-acrylonitrile, methacrylic acid ester-acrylic acid copolymer, vinylidene chloride-acrylic acid copolymer, or vinylidene chloride-acrylic acid ester copolymer, and has a particle size of about 10 μm to 30 μm. When the microcapsule 93 is heated, the substance in the microcapsule 93 starts to evaporate when a predetermined temperature is reached, and the microcapsule 93 expands. The size of the microcapsule 93 in the most expanded state may be appropriately adjusted depending on the application to be used, the type of the substance to be used, and the type of the material of the coating portion, but may be arbitrarily expanded within a range of about 2 to 10 times the particle diameter before expansion. The substance in the microcapsule 93 is in a vaporized state even when it returns to room temperature after heating.

The covering portion 94 fixes the microcapsules 93 so as to be distributed at a substantially uniform density by using a thermoplastic coating agent such as vinyl acetate polymer and acrylic polymer, for example. Further, the covering portion 94 binds the base material layer 91 and the foam layer 92.

As illustrated in FIG. 5B, a recording medium 90*b* having a thermal expansion property representing another mode of the present embodiment may have a configuration including a base material layer 91, a foam layer 92 laminated on the base material layer 91, and a coating layer 95 laminated on the foam layer 92. The provision of the coating layer 95 is excellent in that the foam layer may be protected before and after the foam elevation. Among the configurations of the recording medium 90*b* illustrated in FIG. 5B, the base material layer 91 and the foam layer 92 are as described with reference to the recording medium 90*a* illustrated in FIG. 5A.

The coating layer 95 protects the foam layer and is provided as a surface layer on which a toner image is formed. It is preferable that the coating layer 95 is a layer which may be thermally softened and deformed (raised) following the foam elevation of the foam layer 92 due to the expansion of the microcapsule 93, does not deteriorate even when heated similarly to the foam layer 92, and is excellent in thermal conductivity and can transmit heat energy generated in the toner image to the foam layer 92 without consuming as much as possible in the coating layer 95. Further, after light irradiation, the coating layer 95 may be any material as long as it can quickly cool and solidify in a deformed state and preserve the foamed and raised state of the foamed layer 92. Specifically, it is possible to use a paper such as a high-quality paper or a sheet made of a resin which is generally used. The thickness of the coating layer 95 before deformation is preferable in the range of 1 μm or more and 500 μm or less, more preferably in the range of 30 μm or more and 300 μm or less, from the viewpoint of following the foam bump.

(Configuration of Toner)

In the stereoscopic image forming apparatus and the stereoscopic image forming method of the present embodiment, a toner for developing an electrostatic charge image (also simply referred to as a toner) may be used as a color material containing the compound A that absorbs light.

In particular, as the toner containing the compound A used in the color stereoscopic image forming apparatus and the color stereoscopic image forming method, at least a color toner is used. Here, it is preferable that the color toner does not include a black toner, and the color toner includes yellow, magenta, and cyan toners. A full color stereoscopic image of high image quality may be obtained by using yellow, magenta, and cyan toners. The color toners may further include toners of chromatic colors other than yellow, magenta, and cyan toners, for example, orange, and violet. By further including these other chromatic toners, the color reproduction range may be expanded. Further, if necessary, a white toner may be used together with a chromatic toner.

The color stereoscopic image forming apparatus and the color stereoscopic image forming method may further include a toner other than the color toner, for example, a black toner or a transparent toner. The toner according to the present embodiment is preferably a toner base particle or an aggregate of toner particles. Here, the toner particles are obtained by adding an external additive to the toner base particles, and the toner base particles may be used as they are as toner particles.

<Compound that Absorbs Light>

The light absorbing compound (compound A) contained in the toner is a compound that absorbs light in a wavelength region irradiated by the light irradiation unit, more specifically, light of a light source having a maximum emission wavelength in a wavelength region in the range of 280 to 780 nm.

In the present invention, a compound that absorbs light in a wavelength region irradiated by a light irradiation unit, more specifically, a compound that absorbs light of a light source having a maximum emission wavelength in a wavelength region in the range of 280 to 780 nm, refers to a compound that is dissolved in a solvent (DMF, THF, or chloroform) at a concentration of 0.01 mass % and has an absorbance of 0.01 or more in a wavelength region irradiated, more specifically, in a wavelength region in the range of 280 to 780 nm to be irradiated when the absorbance is measured by a spectrophotometer.

As the compound A used in the present invention, it is preferable to use a colorant (or it may be called a "color material") such as yellow, magenta, cyan, or black, or an ultraviolet absorber. The compound A contained in the toner used in the present invention may be one type or two or more types.

<Colorant>

The toner according to the present invention preferably contains a colorant as the compound A. When the toner contains a colorant as the compound A, the toner absorbs light in a short wavelength region within the range of 280 to 480 nm, so that it is not necessary to change the light source provided in the stereoscopic image forming apparatus 100 depending on the type of the colorant. Therefore, it is unnecessary to provide a mechanism for replacing a plurality of light sources depending on the type of colorant, and space may be saved by forming a simple apparatus. Also, in the manufacture of the toner, it is not necessary to manufacture the toner under a work environment in which ultraviolet rays are cut from the viewpoint of preventing unexpected heat generation due to ultraviolet ray absorption, and it is possible to perform the toner using a normal composition component. Therefore, it is excellent in that it may be manufactured easily and inexpensively in terms of a work environment, the number of processes, and storage management of raw materials. As the colorant, generally known dyes and pigments may be used.

Examples of the colorant for obtaining a black toner include carbon black, a magnetic substance, and iron/-titanium composite oxide black. Examples of the carbon black include channel black, furnace black, acetylene black, thermal black, and lamp black. Examples of the magnetic material include ferrite and magnetite.

Examples of the colorant for obtaining a yellow toner include: dyes such as C.I. Solvent Yellow 19, 44, 77, 79, 81, 82, 93, 98, 103, 104, 112, and 162; and pigments such as C.I. Pigment Yellow 14, 17, 74, 93, 94, 138, 155, 180, and 185.

Examples of the colorant for obtaining a magenta toner include: dyes such as C.I. Solvent red 1, 49, 52, 58, 63, 111, and 122; and pigments such as C.I. Pigment red 5, 48:1, 53:1, 57:1, 122, 139, 144, 149, 166, 177, 178, 222, and 269.

Examples of the colorant for obtaining a cyan toner include: dyes such as C.I. solvent blue 25, 36, 60, 70, 93, dyes such as 95; pigments such as C.I. pigment blue 1, 7, 15, 15:3, 60, 62, 66, and 76.

Examples of the colorant for obtaining toners of chromatic colors other than yellow toners, magenta toners, and cyan toners, for example, pigments such as C.I. Pigment Orange 1 and 11 may be cited as colorants for an orange toner, and pigments such as C.I. Pigment Violet 19, 23, and 29 may be cited as colorants for obtaining a violet toner.

As the colorant for obtaining the toner of each color, one type or a combination of two or more types may be used for each color.

The content of the colorant is preferably in the range of 1 mass % to 30 mass %, more preferably in the range of 2 mass % to 20 mass %, based on the total mass of the toner (100 mass %). When the content is 1 mass % or more, sufficient coloring power may be obtained, and when it is 30 mass % or less, the colorant is not liberated from the toner and adheres to the carrier, and the charging property is stabilized, so that a high-quality image may be obtained.

<UV Absorber>

The toner of the present embodiment preferably contains an ultraviolet (UV) absorber as the compound A. The ultraviolet absorber referred to in the present invention means an additive having an absorption wavelength in a wavelength range of 180 nm or more and 400 nm or less, and deactivating by non-radiation deactivation without accompanied by structural changes such as isomerization or bond cleavage from an excited state under an environment of at least 0° C. or more. The ultraviolet absorber may be any of an organic compound and an inorganic compound as long as the condition is satisfied, and a light stabilizer, an antioxidant, or the like may be used in addition to a general organic ultraviolet absorber.

It is also possible to use an ultraviolet absorbing polymer in which a functional group having a skeleton of an organic ultraviolet absorbing agent is incorporated in a polymer chain.

The UV absorber preferably has a maximum absorption wavelength in a wavelength range of not less than 180 nm and not more than 400 nm, and among the organic ultraviolet absorber and the inorganic ultraviolet absorber, organic ultraviolet absorbers are preferably used.

Organic ultraviolet absorbers that may be used in the present embodiment include known compounds such as: benzophenone-based ultraviolet absorbers, benzotriazole-based ultraviolet absorbers, triazine-based ultraviolet absorbers, cyanoacrylate-based ultraviolet absorbers, salicylate-based ultraviolet absorbers, benzoate-based ultraviolet absorbers, salicylic acid-based ultraviolet absorbers, silicic acid-based ultraviolet absorbers, dibenzoylmethane-based ultraviolet absorbers, β, β-diphenyl acrylate-based ultraviolet absorbers, benzylidene-based ultraviolet absorbers, anthranil-based ultraviolet absorbers, ultraviolet absorbers, ultraviolet absorbers, and 4,4-diarylbutadiene-based ultraviolet absorbers. Among them, benzophenone-based ultraviolet absorbers, benzotriazole-based ultraviolet absorbers, triazine-based ultraviolet absorbers, cyanoacrylate-based ultraviolet absorbers, and dibenzoylmethane-based ultraviolet absorbers are preferable.

These organic-based ultraviolet absorbers may be used alone, or they may be used in combination with two or more.

Examples of the benzophenone-based UV absorber include: octabenzone, 2,4-dihydroxybenzophenone, 2-hydroxy-4-methoxybenzophenone, 2,2'-dihydroxy-4-4'-dimethoxybenzophenone, and 2-hydroxy-4-n-octyloxybenzophenone.

Examples of the benzotriazole-based UV absorber include: 2-(2H-benzotriazol-2-yl)-4,6-bis(1-methyl-1-phenylethyl)phenol, 2-[5-chloro(2H)-benzotriazol-2-yl]-4-methyl-6-(tert-butyl)phenol, 2-(2H-benzotriazol-2-yl), 2-(2H-benzotriazol-2-yl)-4,6-di-tert-pentylphenol, 2-(2H-benzotriazol-2-yl)-4-(1,1,3,3-tetramethylbutyl)phenol, a reaction product of methyl-3-[3-tert-butyl-5-(2H-benzotriazol-2-yl)-4-hydroxyphenyl] propionate/polyethylene glycol (molecular weight about 300), 2-(2H-benzotriazol-2-yl)-6-dodecyl-4-methylphenol, 2-(2-hydroxy-5-tert-butylphenyl)-2H-benzotriazole, 2-ethylhexyl-3-[3-tert-butyl-4-hydroxy-5-(5-chloro-2H-benzotriazol-2-yl) phenyl]propionate, 2-(2H-benzotriazol-2-yl)-4,6-bis(1-methyl-1-phenylethyl)phenol, and 2-(2H-benzotriazol-2-yl)-6-(1-methy-1-phenylethyl)-4-(1,1,3,3-tetramethylbutyl)phenol.

Examples of the triazine-based UV absorber include: 2-(4,6-bis(2,4-dimethylphenyl)-1,3,5-triazine-2-yl)-5-hydroxyphenyl, 2-(4,6-diphenyl-1,3,5-triazine-2-yl)-5-(hexyl) phenol, 2-(2-hydroxy-3-dodecyloxypropyl)oxy-2-hydroxyphenyl]-4,6-bis(2,4-dimethylphenyl)-1,3,5-triazine 2,4-bis(2-hydroxy-4-butyloxyphenyl)-6-(2,4-bis-butyloxyphenyl)-1,3,5-triazine, and 2-(2-hydroxy-4-[1-octyloxycarbonylotoxy]phenyl)-4,6-bis(4-phenyl)-1,3,5-triazine.

Examples of the cyanoacrylate-based UV absorber include: ethyl 2-cyano-3,3-diphenyl acrylate, and 2'-ethylhexyl 2-cyano-3,3-diphenyl acrylate.

Examples of the dibenzoylmethane-based UV absorber include: 4-tert-butyl-4'-methoxydibenzoylmethane (e.g., "Parsol™ 1789" manufactured by DSMs Co. Ltd.).

Examples of the inorganic UV absorber include: titanium oxide, zinc oxide, cerium oxide, iron oxide, and barium sulfate. The particle diameter of the inorganic UV absorber is preferably in the range of 1 nm or more and 1 μm or less in median diameter on a volume basis (Example: 155 nm). The particle size of the UV absorber particles may be measured using an electrophoretic light scattering photometer "ELS-800" (manufactured by Otsuka Electronics Co., Ltd.).

The content of the UV absorber is preferably in the range of 0.1 mass % or more and 50 mass % or less with respect to the total mass of the toner (100 mass %). When the content is 0.1 mass % or more, sufficient exothermic energy may be obtained, and when it is 50 mass % or less, a color stereoscopic image having sufficient fixing strength and sharp edges may be formed. The content of the UV absorber is more preferably in the range of 0.5 mass % to 35 mass %. When the content is 0.5 mass % or more, the obtained thermal energy becomes larger, so that the fixing property is further improved, and when the content is 35 mass % or less, the resin ratio becomes larger, so that the fixed image becomes tougher, the fixing property is further improved, and a color stereoscopic image with sharp edges may be formed.

In addition, the toner of the present embodiment preferably contains a binder resin, a release agent, and a charge control agent in addition to the above-mentioned compound A (colorant and UV absorber) to which an external additive is added. These are explained below.

<Binding Resin>

The binder resin preferably contains an amorphous resin and a crystalline resin. Since the toner according to the present embodiment contains the binder resin, the toner has an appropriate viscosity, and bleeding is suppressed when the toner is applied to a thermally expandable sheet (a foaming sheet) which is a recording medium, so that the thin line reproducibility and the dot reproducibility are improved.

As the binder resin, a resin generally used as a binder resin constituting the toner may be used without limitation. Specific examples include styrene resin, acrylic resin, styrene-acrylic resin, polyester resin, silicone resin, olefin resin, amide resin, and epoxy resin. These binder resins may be used alone or in combination of two or more kinds.

Among these, from the viewpoint of low viscosity and high sharp melt property when melted, the binder resin preferably contains at least one selected from the group consisting of styrene resin, acrylic resin, styrene-acrylic resin, and polyester resin, and more preferably contains at least one selected from the group consisting of styrene-acrylic resin and polyester resin.

The glass transition temperature (Tg) of the binder resin is preferably in the range of not less than 35° C. and not more than 70° C., and more preferably in the range of not less than 35° C. and not more than 60° C. from the viewpoints of fixing property, and heat storage resistance. The glass transition temperature may be measured by differential scanning calorimetry (DSC).

In addition, in the toner according to the present embodiment, it is preferable to contain a crystalline polyester resin as the crystalline resin used for the binder resin from the viewpoint of improving the low-temperature fixing property. In addition, from the viewpoint of further improving the low-temperature fixing property of the toner, it is preferable to contain, as the crystalline polyester resin, a hybrid crystalline polyester resin in which a crystalline polyester resin segment and an amorphous resin segment are combined. As the crystalline polyester resin or the hybrid crystalline polyester resin, for example, a known compound described in Japanese Patent Application Laid-Open (JP-A) No. 2017-37245 may be used.

The toner containing the binder resin may have a single-layer structure or a core-shell structure. The type of the binder resin used for the core particles of the core-shell structure and the shell layer is not particularly limited.

<Release Agent>

The toner according to the present embodiment may contain a release agent. The release agent used is not particularly limited, and various known waxes may be used. Examples of the wax include low molecular weight polypropylene, polyethylene, oxidized low molecular weight polypropylene, polyolefin such as polyethylene, paraffin, and synthetic ester wax.

In particular, synthetic ester waxes are preferably used because of their low melting point and low viscosity, and behenyl behenate, glycerol tribehenate, and pentaerythritol tetrabehenate are particularly preferably used. The content of the release agent is preferably in the range of 1 mass % or more and 30 mass % or less, more preferably in the range of 3 mass % or more and 15 mass % or less, based on the total mass of the toner.

<Charge Control Agent>

The toner according to the present embodiment may contain a charge control agent. The charge control agent used is not particularly limited as long as it can provide positive or negative charging by tribocharging and is colorless, and various known positive charge control agents and negative charge control agents may be used.

The content of the charge control agent is preferably in the range of 0.01 mass % to 30 mass %, more preferably in the range of 0.1 mass % to 10 mass %, based on the total mass of the toner.

<External Additive>

In order to improve the fluidity, charging property, and cleaning property of the toner, an external additive such as a fluidizing agent, or a cleaning aid, which is a so-called post-treatment agent, may be added to the surface of the toner base particle.

Examples of the external additive include inorganic particles such as silica particles, hydrophobic silica particles, alumina particles, titanium oxide particles, inorganic oxide particles such as hydrophobic titanium oxide particles, inorganic stearate compound particles such as aluminum stearate particles, zinc stearate particles, and inorganic titanium oxide compound particles such as strontium titanate particles, and zinc titanate particles. These may be used alone or in combination of two or more kinds.

These inorganic particles may be subjected to surface modification by a silane coupling agent, a titanium coupling agent, a higher fatty acid, or a silicone oil in order to improve heat storage resistance and environmental stability.

The addition amount of these external additives is preferable in the range of 0.05 mass % to 5 mass %, more preferably in the range of 0.1 mass % to 3 mass % (Example: 1.6 mass %) based on the total mass of the toner.

<Average Particle Size of Toner Particles>

The average particle size of the toner particles is preferably in the range of 4 to 10 μm in the volume-based median diameter (D50), more preferably in the range of 4 to 7 μm. When the volume-based median diameter (D50) is within the above range, the transfer efficiency is increased, the image quality of the halftone is improved, and the image quality of the thin line, or dot is improved.

The volume-based median diameter (D50) of the toner particles is measured and calculated using a measuring device in which a "Coulter Counter 3" (manufactured by Beckman Coulter Co., Ltd.) is connected to a computer system (manufactured by Beckman Coulter Co., Ltd.) equipped with a data-processing software "Software V3. 51".

Specifically, 0.02 g of a measurement sample (toner) is added to 20 mL of a surfactant solution (for the purpose of dispersing toner particles, for example, a surfactant solution in which a neutral detergent containing a surfactant component is diluted 10 times with pure water) and conditioned, and then ultrasonic dispersion is performed for 1 minute to prepare a toner particle dispersion liquid. The toner-particle dispersion is pipetted into a beaker containing "ISOTONII" (manufactured by Beckman Coulter, Inc.) in a sample stand until the indicated density of the measuring device is 8%.

By setting the concentration in this range, a reproducible measured value may be obtained. Then, in the measuring device, the measurement particle count number is set to 25,000, the aperture diameter is set to 50 μm, and the frequency value is calculated by dividing the measurement range from 1 to 30 μm into 256, and the frequency value is calculated from the larger volume integration fraction. A particle diameter of 50% is defined as a volume-based median diameter (D50).

<Production Method of Toner>

The method for producing the toner according to the present embodiment is not particularly limited, and although a known method may be employed, an emulsion polymerization aggregation method or an emulsion aggregation method may be suitably employed. Hereinafter, an example of a method for producing a toner containing particles of an ultraviolet absorber and a colorant as the compound A in the toner particles will be described.

The emulsion polymerization aggregation method is a method of manufacturing toner particles by performing shape control by mixing a dispersion liquid of particles of a binder resin (hereinafter, also referred to as binder resin particles) produced by the emulsion polymerization method with a dispersion liquid of particles of an ultraviolet absorption (hereinafter, also referred to as ultraviolet absorber particles), a dispersion liquid of particles of a colorant (hereinafter, also referred to as colorant particles), and, if necessary, a dispersion liquid of a release agent such as wax, to agglomerate the toner particles until the toner particles have a desired particle diameter, and further performing fusion between the binder resin particles.

The emulsion aggregation method is a method of manufacturing toner particles by dropping a binder resin solution dissolved in a solvent into a poor solvent to shape a resin particle dispersion, mixing the resin particle dispersion with an ultraviolet absorber particle dispersion liquid, a colorant particle dispersion liquid, and a release agent dispersion liquid such as wax as necessary, aggregating the resin particles to a desired toner particle diameter, and fusing the binder resin particles. Either manufacturing method is applicable to the toner of the present invention.

Hereinafter, an example of the case where the emulsion polymerization aggregation method is used as the method of manufacturing the toner according to the present invention will be described.

(1) Step of preparing a dispersion liquid comprising colorant particles dispersed in an aqueous medium (2) Step of preparing a dispersion liquid in which ultraviolet absorber particles are dispersed (3) Step of preparing a dispersion liquid in which binder resin particles containing an internal additive are dispersed as necessary in an aqueous medium (4) Step of preparing a dispersion liquid of fine binder resin particles by emulsion polymerization (5) Step of mixing the dispersion liquid of the colorant particles, the dispersion liquid of the ultraviolet absorber particles, and the dispersion liquid of the binder resin particles to form toner base particles by aggregating, associating, and fusing the colorant particles, the ultraviolet absorber particles, and the binder resin particles (6) Step of filtering out the toner base particles from the dispersion system (aqueous medium) of the toner base particles and removing the surfactant (7) Step of drying the toner base particles (8) A step of adding an external additive to the toner base particles. The ultraviolet absorber may not be added.

In the case where the toner is produced by the emulsion polymerization aggregation method, the binder resin particles obtained by the emulsion polymerization method may have a multilayer structure of two or more layers composed of binder resins having different compositions. The binder resin particles having such a configuration, for example, having a two-layer structure, may be obtained by a method in which a dispersion liquid of the resin particles is prepared by an emulsion polymerization process (first stage polymerization) according to a conventional method, a polymerization initiator and a polymerizable monomer are added to the dispersion liquid, and the system is subjected to a polymerization process (second stage polymerization).

Also, toner particles having a core-shell structure may be obtained by an emulsion polymerization aggregation method. Specifically, the toner particles having the core-shell structure may be obtained by first agglomerating, associating, and fusing the binder resin particles for the core particles, the ultraviolet absorber particles, and the colorant particles to produce core particles, and then adding the binder resin particles for the shell layer into the dispersion of the core particles to agglomerate and fuse the binder resin particles for the shell layer on the surface of the core particles to form a shell layer covering the surface of the core particles.

<Developer>

The toner according to the present embodiment may be used, for example, as a one-component magnetic toner containing a magnetic material, as a two-component developer mixed with a so-called carrier, or as a non-magnetic toner used alone. Any of these may be suitably used. Examples of the magnetic material contained in the one-component developer include magnetite, γ-hematite, and various ferrites.

As the carrier constituting the two-component developer, magnetic particles made of conventionally known materials such as metals such as iron, steel, nickel, cobalt, ferrite, and magnetite, and alloys of these metals with metals such as aluminum and lead may be used.

The carrier particles are preferably coated carrier particles obtained by coating the surfaces of magnetic particles with a coating agent such as a resin, or resin-dispersed carrier particles in which magnetic powder is dispersed in a binder resin. Although the coating resin is not limited, examples of the coating resin include an olefin resin, an acrylic resin, a styrene resin, styrene-acrylic resin, a silicone resin, a polyester resin, or a fluorine resin. Although the resin constituting the resin-dispersed carrier particles is not limited, any known resin may be used. Examples of the resin constituting the resin-dispersed carrier particles include an acrylic resin, a styrene-acrylic resin, a polyester resin, a fluororesin, and a phenol resin.

The volume-based median diameter of the carrier particles is preferably in the range of 20 to 100 μm, and more preferably in the range of 25 to 80 μm (example: 32 μm). The volume-based median diameter of the carrier particles may be typically measured by a laser diffraction particle size distribution measuring apparatus "HELOS" (manufactured by SYMPATEC Co., Ltd.) equipped with a wet disperser.

The content of the toner in the developer is preferably in the range of 2 to 10 mass % with respect to 100 mass % of the total mass of the toner and the carrier (Example: 6 mass %).

Although the stereoscopic image forming apparatus and the stereoscopic image forming method according to the present embodiment have been described by taking a stereoscopic image using a toner image formed by an electrophotographic method as an example of a color image according to the present invention, the present invention is not limited to a toner image formed by an electrophotographic method as a color image according to the present invention. A color material used in a color image formed by an inkjet method or an analog printing method may be used.

<Inkjet Method>

Hereinafter, a stereoscopic image using an inkjet image as a color image according to the present invention will be described with respect to the stereoscopic image forming apparatus and the three-dimensional image forming method of the present embodiment. As described above, a stereoscopic image may be formed by irradiating the color material with light of a light source having a maximum emission wavelength in a wavelength range of 280 to 780 nm that is absorbed by a compound contained in the color material fixed on the surface of the foam layer. As this color material, a color inkjet ink for inkjet may be used. A stereoscopic image is formed by irradiating a colorant of a color such as a pigment contained in a color image composed of inkjet ink formed on a thermally expandable sheet or an ultraviolet absorber as necessary.

In the inkjet ink method, an image composed of inkjet ink is output by a known method using inkjet ink, and light of a light source having a maximum emission wavelength in a wavelength region in the range of 280 to 780 nm is irradiated to the color material in the above-described light irradiation step. At this time, in the fixing unit, heating is not particularly necessary, and the landed ink may simply be dried.

The inkjet ink used in the present invention is preferably one suitable for printing on a non-water-absorbing recording medium. Examples of the non-water-absorbing recording medium include a polymer sheet, a board (soft vinyl chloride, hard vinyl chloride, acrylic plate, polyolefin system, and the like), glass, tile, and rubber. Instead of such a recording medium, a color image may be formed on a thermally expandable sheet according to the present invention, and after fixing, a stereoscopic image may be formed in a light irradiation step.

<Inkjet Ink>

As the inkjet ink, a known color ink may be used. When desired, black or gray inks may be used with color inks. For example, as an aqueous inkjet ink suitable for printing on a non-water-absorbing recording medium, an aqueous inkjet ink having a pigment, a polymer dispersant, a water-soluble acrylic resin, and a water-soluble organic solvent may be used. In addition, well-known active light curable inkjet inks or thermal curable inkjet inks may also be used. When needed, the above-mentioned ultraviolet absorber may be contained.

[Water-Soluble Acrylic Resin]

For example, as an inkjet ink, a water-soluble acrylic resin may be contained in an amount of 2 mass % or more and 10 mass % or less of the total mass of the ink. Examples of the (meth)acrylic acid ester which is a copolymer component used for the water-soluble acrylic resin include n-butyl acrylate, 2-ethylhexyl acrylate, 2-hydroxyethyl acrylate, ethyl methacrylate, butyl methacrylate, and glycidyl methacrylate.

As the molecular weight of the water-soluble acrylic resin according to the present invention, one having an average molecular weight of 3000 to 30000 may be used. Preferably, from 7000 to 20000 may be used.

[Water-Soluble Organic Solvent]

The inkjet ink preferably contains at least one water-soluble organic solvent selected from glycol ethers and 1,2-alkanediols having 4 or more carbon atoms from the viewpoint of obtaining high-quality image quality in which spots are suppressed.

Specifically, examples of the glycol ethers include ethylene glycol monoethyl ether, ethylene glycol monobutyl ether, diethylene glycol monobutyl ether, diethylene glycol monoethyl ether, triethylene glycol monobutyl ether, propylene glycol monopropyl ether, dipropylene glycol monomethyl ether, dipropylene glycol monopropylene ether, and tripropylene glycol monomethyl ether. In addition to the above-mentioned glycol ethers and 1,2-alkanediols, conventionally known organic solvents may be added to the inkjet ink.

[Pigment]

As the color pigment applicable to the inkjet ink, as described above, a compound having an absorbance at the maximum emission wavelength in the wavelength range of 280 to 780 nm to be irradiated of 0.01 or more may be used without any particular limitation, and any of a water dispersible pigment and a solvent dispersible pigment may be used. For example, an organic pigment such as an insoluble pigment or a lake pigment, and an inorganic pigment may be preferably used. The pigment is used in a state of being dispersed in the ink by the polymeric dispersant according to the present invention.

The insoluble pigment is not particularly limited, and for example, azo, azomethine, methine, diphenylmethane, triphenylmethane, quinacridone, anthraquinone, perylene, indigo, quinophthalone, isoindolinone, isoindoline, azine, oxazine, thiazine, dioxazine, thiazole, phthalocyanine, and diketopyrrolopyrrole are preferable.

Specific pigments which may be preferably used include the following pigments. Examples of the pigment for magenta or red include: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I.

Pigment Red 139, C.I. Pigment 144, C.I. Pigment 149, C.I. Pigment 166, C.I. Pigment 178 C.I. Pigment Red 222, and C.I. Pigment Violet 19.

Examples of the pigment for orange or yellow include: C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 15:3, C.I. Pigment Yellow 17, C.I. Pigment Yellow 74, C.I. Pigment Yellow 93, C.I. Pigment Yellow 128, C.I. Pigment Yellow 94, C.I. Pigment 138, and C.I. Pigment Yellow 155.

In particular, for the yellow pigment, C.I. Pigment Yellow 155 is preferable in the balance of color tone and light resistance.

Examples of the pigment for green or cyan include, for example, C.I. pigment blue 15, C.I. pigment blue 15:2, C.I. pigment blue 15:3, C.I. pigment blue 16, C.I. pigment blue 60, C.I. pigment green 7 and the like.

Examples of the black pigment include: C.I. Pigment Black 1, C.I. Pigment Black 6, C.I. and Pigment Black 7. They may be used within the range that does not impair the effect of the present invention.

The average particle diameter of the pigment contained in the inkjet ink in the dispersed state is preferably 50 nm or more and less than 200 nm.

When the average particle diameter of the pigment dispersion is in the range of 50 to 200 nm, the stability of the pigment dispersion is good, and the storage stability of the ink is not easily deteriorated.

The particle size measurement of the pigment dispersion may be obtained by a commercially available particle size measuring instrument using a dynamic light scattering method, or an electrophoresis method, but the measurement by a dynamic light scattering method is simple and the particle size region is frequently used with high accuracy.

The pigment according to the present invention is preferably dispersed by a disperser together with a dispersant and other necessary additives according to various desired purposes. As the disperser, a conventionally known ball mill, sand mill, line mill, or high pressure homogenizer may be used. Among them, the particle size distribution of the ink produced by dispersion by a sand mill is sharp and preferable.

The material of the beads used for sand mill disperse is preferably zirconia or zircon from the viewpoint of contamination of bead fragments and ionic components. The bead diameter is preferably in the range of 0.3 to 3 mm.

[Polymer Dispersant]

The polymer dispersant referred to in the present invention has a polymer component having a molecular weight of 5,000 or more and 200,0000 or less. Examples of the type of the polymer dispersant include block copolymers composed of two or more monomers selected from styrene, styrene derivatives, vinylnaphthalene derivatives, acrylic acid, acrylic acid derivatives, maleic acid, maleic acid derivatives, itaconic acid, itaconic acid derivatives, fumaric acid, fumaric acid derivatives, random copolymers and salts thereof, polyoxyalkylene, and polyoxyalkylene alkylene alkyl.

[Surfactants and Other Additives]

In inkjet inks, particularly when a non-water-absorbing recording medium is used as the recording medium, it is preferable to use a surfactant from the viewpoint of providing high wettability. In addition, various additives may be added as necessary.

(Fixing)

The inkjet method is used, and more specifically, the inkjet ink is ejected as droplets from a fine nozzle, and the droplets are deposited on a recording medium. The discharge method is not particularly limited, and for example, a known method such as a continuous injection type (charge control type, or spray type), an on-demand type (piezo type, thermal type, or electrostatic attraction type) may be adopted.

The ejection amount of the droplet from which the inkjet ink is ejected from the nozzle may be appropriately set in consideration of the printing speed, the drying time, and the like. Usually, it is in the range of 1 to 30 pL, preferably 2 to 20 pL, more preferably 3 to 10 pL.

After the inkjet ink droplets are ejected and adhered onto the recording medium, natural drying, or heating drying is performed. As a result, the inkjet ink may be dried and fixed firmly on the recording medium. The drying time and the drying temperature are not particularly limited, and may be appropriately set according to the printing speed and the like. In the case of performing heat drying, the method is not particularly limited as long as it promotes evaporation of the solvent (water) in the inkjet ink. For example, hot air is blown onto a recording medium to which droplets of inkjet ink adhere, hot air treatment such as radiation heating, conduction heating, or high-frequency drying, or heating by a heater may be given.

EXAMPLES

Hereinafter, the present invention will be described in detail with reference to examples, but the present invention is not limited thereto. In the examples, "parts" or "%" is used, but unless otherwise specified, it indicates "parts by weight" or "percent by weight".

[Preparation of Colorant Particle Dispersion]

The following pigments were used as colorants to prepare colorant fine particle dispersions.

(Preparation of Yellow Colorant Particle Dispersion [Ye])

| | |
|---|---|
| Sodium dodecyl sulfate: | 90 parts by weight |
| C.I. Pigment Yellow 74: | 200 parts by weight |
| Ion-exchanged water: | 1600 parts by mass |

After sufficiently dispersing the solution obtained by mixing the above components in ULTRA-TURRAX T50 (manufactured by IKA Co.), the solution was treated in an ultrasonic disperser for 20 minutes to obtain a yellow colorant particle dispersion liquid [Ye]. The volume-based median diameter of the colorant particles was 240 nm.

(Preparation of Cyan Colorant Particle Dispersion [Cy])

| | |
|---|---|
| Sodium dodecyl sulfate: | 90 parts by weight |
| C.I. Pigment Blue 15:3: | 200 parts by weight |
| Ion-exchanged water: | 1600 parts by mass |

After sufficiently dispersing the solution obtained by mixing the above components in ULTRA-TURRAX T50 (manufactured by IKA Co.), the solution was treated in an ultrasonic disperser for 20 minutes to obtain a cyan colorant particle dispersion liquid [Cy]]. The volume-based median diameter of the colorant particles was 180 nm.

[Preparation of Resin Particle Dispersion]

<Preparation of Styrene-Acrylic Resin Particle Dispersion Liquid [Dispersion Liquid C1]>

5.0 parts by mass of sodium lauryl sulfate and 2,500 parts by mass of ion-exchanged water were placed in a 5 L reactor equipped with a stirring device, a temperature sensor, a cooling tube, and a nitrogen introducing device, and the internal temperature was raised to 80° C. while stirring at a stirring rate of 230 rpm under a stream of nitrogen. Next, an aqueous solution in which 15.0 parts by mass of potassium persulfate (KPS) was dissolved in 300 parts by mass of ion-exchanged water was added to bring the solution temperature to 80° C. again. Thereafter, a monomer mixture consisting of 840.0 parts by mass of styrene (St), 288.0 parts by mass of n-butyl acrylate (BA), 72.0 parts by mass of methacrylic acid (MAA), and 15 parts by mass of n-octyl mercaptan was added dropwise over 2 hours. After completion of the dropwise addition, polymerization was carried out by heating and stirring at 80° C. for 2 hours to prepare a dispersion liquid C1 of styrene-acrylic resin [c1] particles having a volume-based median diameter of 120 nm. The glass transition temperature (Tg) of the styrene-acrylic resin [c1] was 52.0° C., and the weight average molecular weight (Mw) was 28,000.

[Preparation of Ultraviolet Absorber Dispersion]

<Preparation of Ultraviolet Absorber Particle Dispersion Liquid 1>

80 parts by mass of dichloromethane, and 20 parts by mass of benzophenone (Uvinul3049; manufactured by BASF Co.) as an ultraviolet ray absorber were mixed and stirred while heating at 50° C. to obtain a liquid containing benzophenone. To 100 parts by mass of this solution, a mixed solution of 99.5 parts by mass of distilled water warmed to 50° C. and 0.5 parts by mass of a 20 mass % sodium dodecylbenzene sulfonate aqueous solution was added. Thereafter, the mixture was stirred at 16,000 rpm for 20 minutes by a homogenizer (manufactured by Heidolph Corporation) equipped with a shaft generator 18F to be emulsified, thereby obtaining a benzophenone emulsion 1. The obtained benzophenone emulsion 1 was put into a separable flask, and the organic solvent was removed by heating and stirring at 40° C. for 90 minutes while feeding nitrogen into the gas phase, and then ion-exchanged water was added to the dispersion to adjust the solid content to 20 mass %, thereby obtaining an ultraviolet absorber particle dispersion 1. The particle diameter of the ultraviolet absorption particles in the ultraviolet absorber particle dispersion liquid 1 was measured using an electrophoretic light scattering photometer (ELS-800; manufactured by Otsuka Electronics Co., Ltd.), and the mass-average particle diameter was 145 nm.

[Preparation of Infrared Absorber Dispersion]

<Preparation of Infrared Absorber Particle Dispersion Liquid 1>

Anionic surfactant: 90 g of sodium dodecylbenzene sulfonate was stirred and dissolved in 1,600 ml of ion-exchanged water, 420 g of a dithiol nickel complex "SIR-130" (manufactured by Mitsui Chemicals Inc.) was gradually added as an infrared absorber while stirring this solution, followed by dispersion treatment using a stirrer "CLEAMIX" (manufactured by M Technique Co. Ltd.). Then adjustment was done so that the solid content was 20 mass % to prepare an infrared absorber fine particle dispersion 1 in which infrared absorber particles were dispersed. The particle diameter of the infrared absorber particles in the infrared absorber particle dispersing liquid 1 was measured using an electrophoretic light scattering photometer "ELS-800" (manufactured by Otsuka Electronics Co., Ltd.), and the volume-based median diameter was 80 nm.

[Production of Cyan Toner Cy1 and Cyan Developer Cy1]

<Preparation Process of Toner Base Particles>

After 1483.3 parts by mass (445.0 parts by mass in terms of solid content) of styrene-acrylic resin particle dispersion liquid [dispersion C1], 236.3 parts by mass (25.0 parts by mass in terms of solid content) of colorant particle dispersion liquid [Cy], and 1500 parts by mass of ion-exchanged water were put into a reaction vessel equipped with a stirring device, a temperature sensor, and a cooling tube, a 5 mol/liter aqueous solution of sodium hydroxide was added to adjust the pH to 10. Next, an aqueous solution in which 45.0 parts by mass of magnesium chloride was dissolved in 45.0 parts by mass of ion-exchanged water was added at 30° C. for 10 minutes under stirring. The heating was started, the system was heated to 80° C. over 60 minutes. The particle size of the associated particles was measured using "Coulter Multisizer 3" (manufactured by Beckman Coulter, Inc.), and the stirring speed was controlled such that the volume-based median diameter was 6.0 μm. Thereafter, an aqueous solution in which 45.0 parts by mass of sodium chloride was dissolved in 180.0 parts by mass of ion-exchanged water was added to stop the particle growth. Further, the particles were fused by heating and stirring at 80° C. When the average circularity became 0.957 using a measuring device of the average circularity of the toner particles (HPF detection number: 4000 pieces) (manufactured by FPIA-2100; Sysmex Co.), the toner particles were cooled to 30° C. at a cooling rate of 5° C./min.

Next, the dispersion of toner particles was separated in solid-liquid, and dehydrated toner cakes were repeatedly washed three times by re-dispersing them in ion-exchanged water, and then dried at 40° C. for 24 hours to obtain toner base particles [Cy1].

<Addition Process of External Additive>

To 100 parts by mass of the resulting toner base particles [Cy1], 0.6 parts by mass hydrophobic silica (average primary particle diameter=12 nm, hydrophobicity=68) and 1.0 parts by mass of hydrophobic titanium oxide (average primary particle diameter=20 nm, hydrophobicity=63) were added. After the external additive treatment step of mixing at 32° C. for 20 minutes at a rotating blade peripheral speed of 35 m/sec by a "Henschel mixer" (manufactured by Mitsui Miike Kakoki Co., Ltd.), coarse particles were removed using a 45 μm mesh sieve. As a result, a cyan toner [Cy1] composed of the toner particles [Cy1] was obtained.

<Preparation Process of Developer>

A cyan developer [Cy1] was obtained by mixing the cyan toner [Cy1] with a ferrite carrier having a volume-average particle diameter of 30 μm coated with a copolymer resin (monomer mass ratio=1:1) of cyclohexyl methacrylate and methyl methacrylate so that the toner concentration became 6 mass %.

[Production of Cyan Toner Cy2 and Cyan Developer Cy2]

A cyan toner [Cy2] and a cyan developer [Cy2] were prepares in the same manner as the production of the cyan toner Cy1 and the cyan developer Cy1, except that 1483.3 parts by mass (solid equivalent 445.0 parts by mass) of the styrene-acrylic resin particle dispersion liquid [dispersion liquid C1] was changed to 1450.0 parts by mass (solid equivalent 435.0 parts by mass) of the styrene-acrylic resin particle dispersion liquid [dispersion liquid C1] and 150.0 parts by mass (solid equivalent 10.0 parts by mass) of the ultraviolet absorber particle dispersion liquid.

[Production of Yellow Toner Ye1 and Yellow Developer Ye1]

A yellow toner Ye1 and a yellow developer Ye1 were produced in the same manner as the production of the cyan toner Cy1 and the cyan developer Cy1, except that the cyan colorant particle dispersion [Cy] was changed to the yellow colorant particle dispersion [Ye].

[Production of Transparent Toner T1 and Transparent Developer T1]

A transparent toner [T1] and a transparent developer [T1] were produced in the same manner as the production of the cyan toner Cy1 and the cyan developer Cy1, except that the following change was done. 1483.3 parts by mass (solid content: 445.0 parts by mass) of styrene-acrylic resin particle dispersion [dispersion C1] and 236.3 parts by mass (solids content: 25.0 parts by mass) of colorant particle dispersion [Cy] were changed to 1533.3 parts by mass (solids equivalent 460.0 parts by mass) of a styrene-acrylic resin particle dispersion [dispersion C1] and 150.0 parts by mass (solids equivalent 10.0 parts by mass) of an infrared absorber particle dispersion.

<<Evaluation>>

[Preparation of Fixed Image and Stereoscopic Image]

In the following evaluations, an electrostatic latent image having a size of 100 mm×100 mm was developed and fixed on an A4-size thermally expandable sheet (a three-layered thermally expandable sheet including a base material layer, a microcapsule-containing foam layer, and a coating layer indicated in FIG. 1) in an ambient temperature and humidity environment (temperature of 20° C., humidity of 50% RH) by using bizhub PRESS C1070 (manufactured by Konica Minolta, Inc.) under conditions of toner adhesion 4 g/m$^2$ to form a toner fixed image. The total adhesion amount of the toners was adjusted so as to be 4 g/m$^2$, and the mass ratio (%) of the toners of the respective colors was as indicated in the table.

Figure 6:
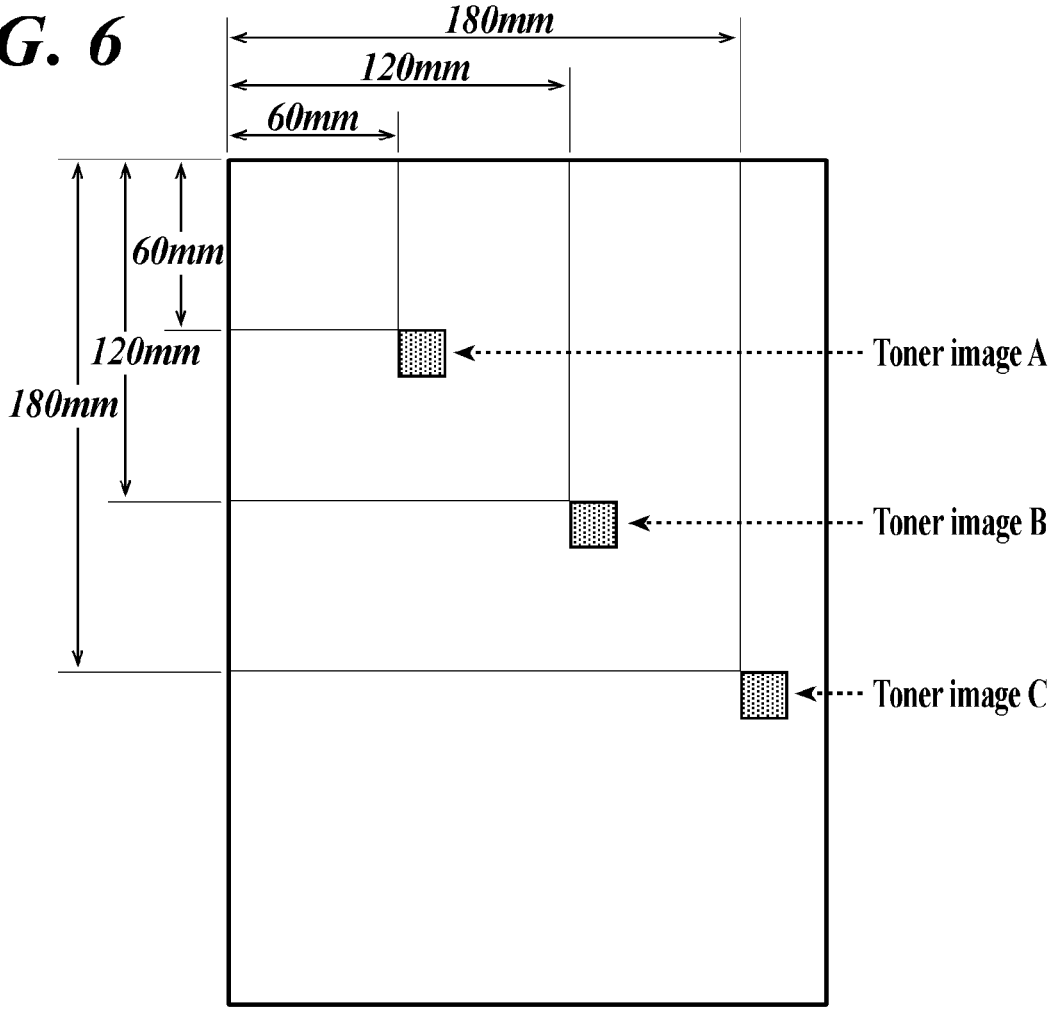
FIG. 6 is position information of color images A to C formed on a thermally expandable sheet.

By using the light irradiation apparatus, the toner image was irradiated with light from an LED which is a light irradiation unit, thereby stereoscopic images 1 to 9 were prepared. In the production of the stereoscopic image 7, a 30 mm×30 mm electrostatic latent image was developed and fixed with reference to the positional information of the toner images A to C formed on the thermally expandable sheet indicated in FIG. 6. After forming a toner-fixed image, the toner images A to C were irradiated with light at the light amounts indicated in the table.

[Evaluation: Color Reproducibility Test]

As comparative samples, images fixed on plain paper (basis weight: 64/m$^2$) in sizes of 100 mm×100 mm were outputted by bizhub PRESS C1070 (Konica Minolta Co., Ltd.) under the condition that the toner adhering amount was 4 g/m$^2$. The stereoscopic image sample and the comparative sample were compared and evaluated at the following three levels. The levels AA and BB are acceptable.

AA: Differences in color cannot be distinguished.

BB: Color difference is slightly recognized, but there is no practical problem.

CC: Difference in color is greatly recognized.

[Evaluation: Edge Test]

The sharpness of the edge portion of the image was evaluated by the following three levels. The levels AA and BB are acceptable.

AA: Swelling of edge portion is sharp and has excellent stereoscopic appearance.

BB: The bulge of the edge portion is slightly widened, but a sharp stereoscopic effect is expressed and there is no problem in practical use.

CC: The bulge of the edge portion is gentle, and a sharp stereoscopic effect cannot be recognized.

The results are indicated in Table I. Note that in the table, the compounds (yellow, cyan colorant and ultraviolet absorber) according to the present invention and the comparative compounds (infrared absorber) in which the absorbance at the maximum emission wavelength in the wavelength range of 280 to 780 nm to be irradiated is 0.01 or more are indicated in the column of "Compound that absorbs light within the wavelength to be irradiated". Absorbance was measured and confirmed at a maximum emission wavelength indicated in Table I using a spectrophotometer "V-530" (manufactured by JASCO Corporation) after dissolving at a concentration of 0.01 mass % in a solvent (DMF).

TABLE I

| Stereoscopic | Configuration of Toner | | | | | | | |
|---|---|---|---|---|---|---|---|---|
| | Kind of Toner | | | Ratio of Each Toner (mass %) | | | Compound that absorbs light within the wave length to be irradiated | |
| Image No. | Yellow | Cyan | *1 | Yellow | Cyan | *1 | Yellow | Cyan |
| 1 | Ye1 | — | — | 100 | — | — | Colorant | — |
| 2 | Ye1 | — | — | 100 | — | — | Colorant | — |
| 3 | Ye1 | — | — | 100 | — | — | Colorant | — |
| 4 | Ye1 | — | — | 100 | — | — | Colorant | — |
| 5 | Ye1 | Cy1 | — | 20 | 80 | — | Colorant | Colorant |
| 6 | — | Cy2 | — | — | 100 | — | — | Colorant/ UV absorber |
| 7 | Ye1 | — | — | 100 | — | — | Colorant | — |
| 8 | Ye1 | Cy1 | T1 | 40 | 20 | 40 | Colorant | Colorant |
| 9 | Ye1 | Cy1 | T1 | 40 | 20 | 40 | Colorant | Colorant |

| Stereoscopic Image No. | Configuration of Toner Compound that absorbs light within the wave length to be irradiated *1 | Light irradiation step | | | | Evaluation result | | |
|---|---|---|---|---|---|---|---|---|
| | | Light source | Maximum emission wavelength (nm) | Wavelength region of the irradiation light (nm) | Light amount (J/cm$^2$) | Color reproducibility test | Edge test | Remarks |
| 1 | — | LED | 365 | 365 ± 20 | 7.2 | AA | AA | *2 |
| 2 | — | LED | 385 | 385 ± 10 | 7.5 | AA | AA | *2 |

TABLE I-continued

| | | | | | | | | |
|---|---|---|---|---|---|---|---|---|
| 3 | — | LED | 405 | 405 ± 10 | 7.6 | AA | AA | *2 |
| 4 | — | LED | 480 | 480 ± 20 | 8.2 | AA | AA | *2 |
| 5 | — | LED | 780 | 780 ± 20 | 9.0 | AA | BB | *2 |
| 6 | — | LED | 365 | 365 ± 20 | 6.0 | AA | AA | *2 |
| 7 | — | LED | 365 | 365 ± 20 | 7.2 Toner image A | AA | AA | *2 |
| | | | | | 12.0 Toner image B | AA | AA | *2 |
| | | | | | 17.0 Toner image C | AA | AA | *2 |
| 8 | Infrared ray absorber | LED | 1050 | 1050 ± 20 | 7.1 | CC | CC | *3 |
| 9 | Infrared ray absorber | Halogen lamp | 1000 | 400~3000 | 7.1 | CC | BB | *3 |

*1: Transparent
*2: Present invention
*3: Comparative example

Table I demonstrates that the stereoscopic image of the present invention has excellent color reproducibility and sharp edges.

What is claimed is:

1. A stereoscopic image forming method for forming a color stereoscopic image on a thermally expandable recording medium having a thermal expansion property, the stereoscopic image forming method comprising:

fixing a color image on the thermally expandable recording medium using a color material; and irradiating the fixed color image with light of a light source having a maximum emission wavelength in a wavelength range of 280 to 780 nm that is absorbed by a compound contained in the color material to generate heat of the compound, wherein in the irradiating, the fixed color image is irradiated with the light at a dose ranging from 1.0 to 20.0 J/cm$^2$.

2. The stereoscopic image forming method described in claim 1, wherein in the irradiating, the maximum emission wavelength is in a wavelength range of 280 to 480 nm.

3. The stereoscopic image forming method described in claim 1, wherein the color material is electrophotographic color toner.

4. The stereoscopic image forming method described in claim 1, wherein in the irradiating, the light source is a light emitting diode or a laser light source.

5. The stereoscopic image forming method described in claim 1, wherein in the irradiating, a light irradiation position is set based on a position information of the color image.

6. The stereoscopic image forming method described in claim 1, wherein in the irradiating, a light irradiation amount is set based on a stereoscopic image information of the color image.

7. The stereoscopic image forming method described in claim 1, wherein the color material contains a colorant as the compound.

8. The stereoscopic image forming method described in claim 1, wherein the color material contains an ultraviolet absorber as the compound.

9. The stereoscopic image forming method described in claim 1, wherein the thermally expandable recording medium has a foam layer containing microcapsules expanded by heating on a base material layer.

10. A stereoscopic image forming apparatus for forming a color stereoscopic image on a thermally expandable recording medium, wherein the stereoscopic image forming apparatus comprises:

a fixing unit for fixing a color image on the thermally expandable recording medium using a color material; and a light irradiating unit for irradiating the fixed color image with light of a light source having a maximum emission wavelength in a wavelength range of 280 to 780 nm that is absorbed by a compound contained in the color material to generate heat of the compound, wherein the light irradiation unit is configured to irradiate the fixed color image with the light at a dose ranging from 1.0 to 20.0 J/cm$^2$.

* * * * *